US006050184A

United States Patent [19]

Kidoura et al.

[11] Patent Number: 6,050,184

[45] **Date of Patent: *Apr. 18, 2000**

[54] THERMAL MASTER MAKING DEVICE AND THERMAL RECORDING DEVICE

[75] Inventors: Yasunobu Kidoura, Shibata-machi; Satoshi Katoh, Kakuda; Yoshiyuki Shishido, Kakuda; Yasumitsu Yokoyama, Kakuda, all of Japan

[73] Assignee: Tohoku Ricoh Co., Ltd., Shibata-gun, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/986,636

[22] Filed: Dec. 8, 1997

[30] Foreign Application Priority Data

Mar. 25, 1997 [JP] Japan ..... 9-072081

[51] Int. Cl.[7] ..... B41J 2/35

[52] U.S. Cl. ..... 101/128.4; 347/211; 400/120.16

[58] Field of Search ..... 101/128.21, 128.4; 400/648, 659, 662, 120.16; 347/197, 198, 211

[56] References Cited

U.S. PATENT DOCUMENTS

| | | | |
|---|---|---|---|
| 4,422,376 | 12/1983 | Teraoka | 400/120.16 |
| 4,957,378 | 9/1990 | Shima | 101/128.4 |
| 5,048,416 | 9/1991 | Iijima | 101/122 |
| 5,062,722 | 11/1991 | Shiozaki et al. | 400/56 |
| 5,535,671 | 7/1996 | Kanno | 101/128.4 |

FOREIGN PATENT DOCUMENTS

| | | |
|---|---|---|
| 62-131841 | 8/1987 | Japan . |
| 69359 | 3/1989 | Japan . |
| 69374 | 3/1989 | Japan . |
| 286880 | 11/1989 | Japan . |
| 4-90374 | 3/1992 | Japan . |
| 4-73575 | 6/1992 | Japan . |
| 4-371872 | 12/1992 | Japan . |
| 31932 | 2/1993 | Japan . |
| 6-320700 | 11/1994 | Japan . |
| 7-61750 | 7/1995 | Japan . |
| 8-99419 | 4/1996 | Japan . |
| 8-142444 | 6/1996 | Japan . |
| 9-11600 | 1/1997 | Japan . |

*Primary Examiner*—Stephen R. Funk
*Attorney, Agent, or Firm*—Oblon, Spivak, McClelland, Maier & Neustadt, P.C.

[57] ABSTRACT

A thermal master making device and a thermal recording device each including a thermal head and a platen roller. The master making device thermally perforates, or cuts, a thermosensitive stencil for making a master while the recording device thermally records an image on a thermosensitive recording medium. The devices each reduce the corrosion of an expensive thermal head in any environmental conditions while guaranteeing the conveyance of the stencil or the recording medium. The stencil and recording medium each contain a corrosive substance in an antistatic agent or adhesive or an overcoat layer thereof. The corrosion of the head would directly translate into defective images. With the above devices, it is possible to reduce a burden on the user and to extend the life of the head. Extending the life of the head is desirable from the environmental standpoint also.

7 Claims, 12 Drawing Sheets

THERMAL MASTER MAKING DEVICE AND THERMAL RECORDING DEVICE

BACKGROUND OF THE INVENTION

The present invention relates to a thermal master making device for thermally perforating a thermosensitive stencil to thereby make a master, and a thermal recording device for thermally recording an image on a thermosensitive recording medium. The two devices each includes a thermal head and a platen roller.

A thermal master making device and a thermal recording device have customarily been included in a digital thermal stencil printer and a digital thermal recorder, respectively. The conventional thermal master making device and thermal recording device have the following problems (1)–(3) left unsolved.

(1) Substantial friction acts between a thermosensitive stencil used in the thermal master making device or a thermosensitive recording medium used in the thermal recording device and a platen roller and a thermal head. The resulting static electricity charges the periphery of the platen roller, the surface of the head to contact the stencil or the recording medium, and the surface of the stencil or that of the recording medium. The static electricity is apt to cause the stencil or the recording medium to adhere to and wrap around the platen roller on which a great amount of charge is deposited, thereby obstructing the conveyance of the stencil or the recording medium.

(2) The thermal head includes a resistance layer implementing a plurality of heating elements, and A1 (aluminum) lead electrodes formed on the resistance layer. This kind of thermal head is apt to crack at the stepped edge portions of the lead electrodes. Further, fine impurities are apt to deposit on the lead electrodes and then peeled off, leaving their traces in the form of pin-holes in a protection layer covering the electrodes.

(3) After operation, some potentials are left on the platen roller, stencil or recording medium, and head. Such residual potentials cause the platen roller, stencil or recording medium, cracks and traces of impurities formed in the head, lead electrodes and heating elements to form a current path, so that a small current flows through the current path. The current causes corrosive substances applied to the stencil or the recording medium to turn out corrosive ion products and corrode or oxidize the lead electrodes and heating elements. In the end this obstructs the selective feed of a voltage to the heating elements and prevents the heating elements from generating heat. Images formed in the stencil or on the recording medium in the above condition are partly lost or otherwise defective. Replacing the head which is expensive is a burden on the user and is not desirable from the environment standpoint also.

SUMMARY OF THE INVENTION

It is therefore an object of the present invention to provide a thermal master making device and a thermal recording device capable of ensuring desirable transport of a thermosensitive stencil or a thermosensitive recording medium in any environmental conditions.

It is another object of the present invention to provide a thermal master making device and a thermal recording device enhancing the durability and reliability of a thermal head.

It is still another object of the present invention to provide a thermal master making device and a thermal recording device capable of reducing the corrosion or oxidation of a thermal head to thereby reduce defective images.

It is a further object of the present invention to provide a thermal master making device and a thermal recording device capable of reducing a burden on the user and desirable from the environment standpoint.

In accordance with the present invention, a device for thermally recording an image represented by an image signal on a thermosensitive recording medium moving in the subscanning direction includes a conductive platen roller having at least the circumferential surface thereof formed of a conductive material. A thermal head includes a plurality of heating elements arranged in a main scanning direction perpendicular to the subscanning direction. The heating elements are selectively energized in accordance with the image signal to thereby thermally record the image on the recording medium intervening between the thermal head and the platen roller. A moving mechanism selectively moves the thermal head and platen roller into or out of contact with each other.

Also, in accordance with the present invention, a device for thermally recording an image represented by an image signal on a thermosensitive recording medium moving in the subscanning direction includes a conductive platen roller having at least the circumferential surface thereof formed of a conductive material. A thermal head includes a plurality of heating elements arranged in a main scanning direction perpendicular to the subscanning direction. The heating elements are selectively energized in accordance with the image signal to thereby thermally record the image on the recording medium intervening between the thermal head and the platen roller. An opening/closing device selectively opens or closes a current path to thereby connect either one of the platen roller and heating elements to ground.

Further, in accordance with the present invention, a device for thermally perforating a thermosensitive stencil moving in the subscanning direction in accordance with an image signal to thereby make a master includes a conductive platen roller having at least the circumferential surface thereof formed of a conductive material. A thermal head includes a plurality of heating elements arranged in a main scanning direction perpendicular to the subscanning direction. The heating elements are selectively energized in accordance with the image signal to thereby thermally perforate the stencil. A moving mechanism selectively moves the thermal head and platen roller into or out of contact with each other.

Moreover, in accordance with the present invention, a device for thermally perforating a thermosensitive stencil moving in the subscanning direction in accordance with an image signal to thereby make a master includes a conductive platen roller having at least the circumferential surface thereof formed of a conductive material. A thermal head includes a plurality of heating elements arranged in a main scanning direction perpendicular to the subscanning direction. The heating elements are selectively energized in accordance with the image signal to thereby thermally perforate the stencil. An opening/closing device selectively opens or closes a current path to thereby connect either one of the platen roller and heating elements to ground.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
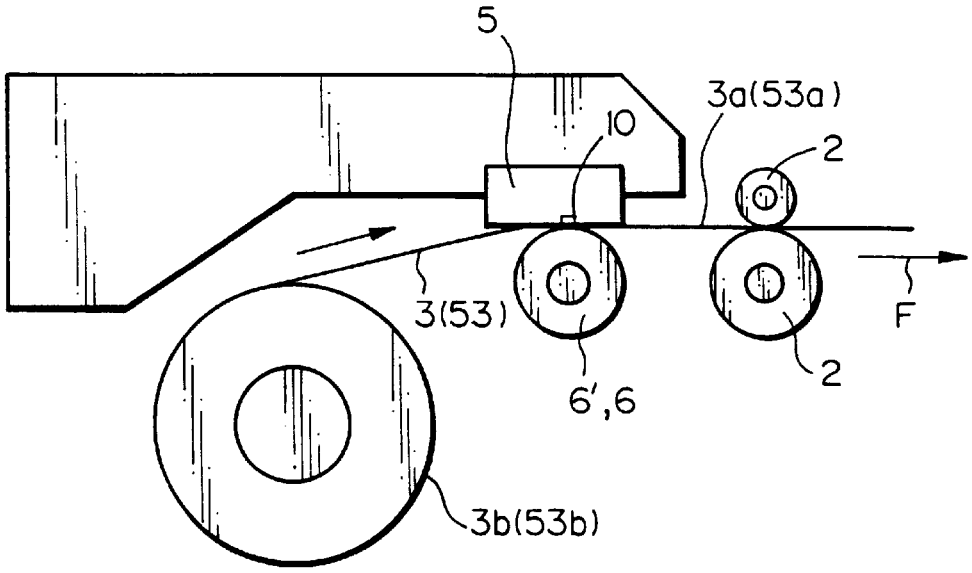
Fig. 1 PRIOR ART
FIG. 1 is a fragmentary front view showing a conventional thermal master making device and a conventional thermal recording device.

To better understand the present invention, brief reference will be made to a conventional digital thermal master making device, shown in FIG. 1. As shown, the master making device includes a thermal head 5 having a plurality of heating elements or resistance bodies 10 arranged in the main scanning direction. A stencil 3 having a thermoplastic resin film 3*a* is passed between the thermal head 5 and a platen roller 6' and conveyed in the subscanning direction F perpendicular to the main scanning direction. The heating elements 10 are selectively energized in accordance with an image signal so as to perforate, or cut, the resin film 3*a* of the stencil 3 by heat.

Specifically, the stencil 3 paid out from a stencil roll 3*b* is conveyed in the subscanning direction F by a roller pair 2 and inserted between the head 5 and the platen roller 6'. The heating elements 10 selectively energized, as mentioned above, form a dot image in the side of the resin film 3*a* facing the heating elements 10 by heating it. Substantial friction acts between the stencil 3 and the platen roller 6' and between the stencil 3 and the head 5 during the above master making operation or during conveyance preceding or following the master making operation. The resulting static electricity charges the periphery of the platen roller 6', the surface of the head 5 contacting the stencil 3, and the stencil 3 itself. As a result, a potential difference occurs between the stencil 3 and the platen roller 6' and between the stencil 3 and the head 5. This causes the stencil 3 to adhere to and wrap around the platen roller 6' on which a greater amount of charge is deposited than on the others, resulting in defective conveyance of the stencil 3.

The stencil 3 may be provided with a laminate structure consisting of a film of polyester or similar thermoplastic resin and Japanese paper, synthetic fibers or a combination thereof affixed to the film by adhesive. This kind of structure successfully increases a conveying force to act on the stencil 3. Usually, the laminate type stencil 3 includes a layer constituted by a trace of antistatic agent. Alternatively, the stencil 3 may be implemented substantially only by a thermostatic resin film including an antistatic agent. For the antistatic agent, use may be made of an organic sulphonic metal salt or similar hygroscopic substance, as taught in, e.g., Japanese Patent Laid-Open Publication No. 6-320700, or a tetraammonium salt type or similar cationic agent, as taught in Japanese Patent Publication No. 7-61750. Such an antistatic agent is applied to or otherwise deposited on the resin film, forming an antistatic agent layer.

To prevent the stencil 3 from wrapping around the platen roller 6', Japanese Utility Model Laid-Open Publication No. 4-73575, for example, discloses a conductive platen roller having a specific surface resistance of $10^9$ Ω or below. This document teaches that such the conductive platen roller obviates the above problem even in a low humidity atmosphere.

The configuration of a thermal recording device will be briefly described with reference to FIG. 1. The structural elements of the thermal recording device are distinguished from the structural elements of the above thermal master making device by parentheses. As shown, thermosensitive paper or similar thermosensitive recording medium 53 is paid out from a roll 53*b*, so that an image is printed on the recording surface 53*a* of the paper 53. The thermal head 5 and a platen roller 6 similar to the platen roller 6' are arranged in the same manner as in the master making device. As shown in FIG. 1 of Japanese Utility Model Laid-Open Publication No. 62-131841, the platen roller 6' is implemented as a conductive platen roller 9 having a shaft 9*a*. The shaft 9*a* is electrically connected to ground GND via a lead 12 so as to release static electricity. This protects the insulative protective film of the head from damage ascribable to static electricity and thereby prevents the resistance of a heating element layer from decreasing.

Figure 2:
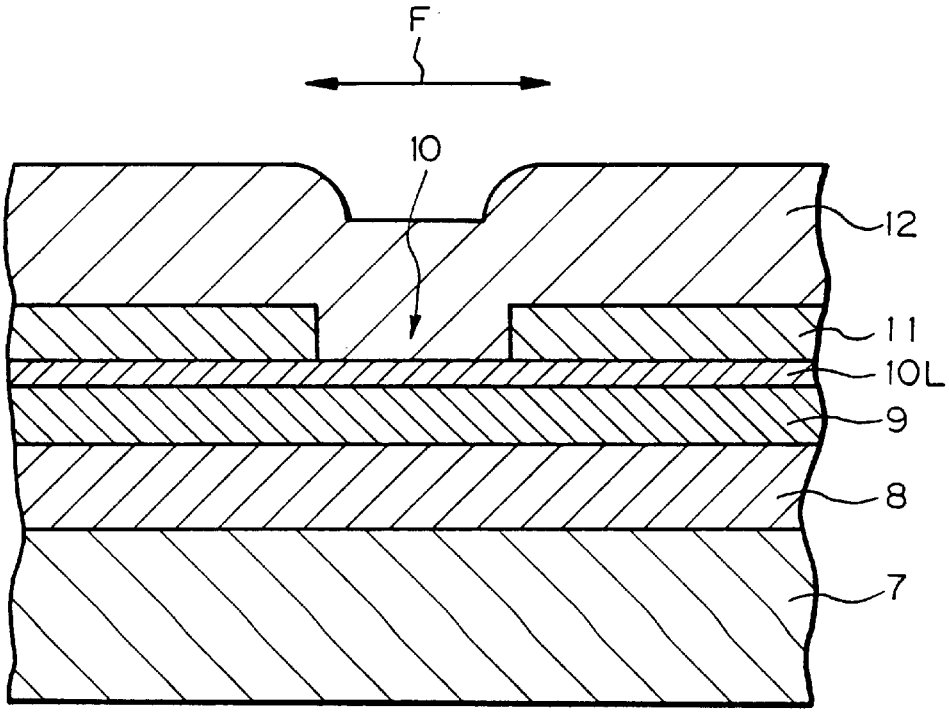
Fig. 2 PRIOR ART
FIG. 2 is a fragmentary section showing a thermal head included in each of the devices shown in FIG. 1.
Figure 4:
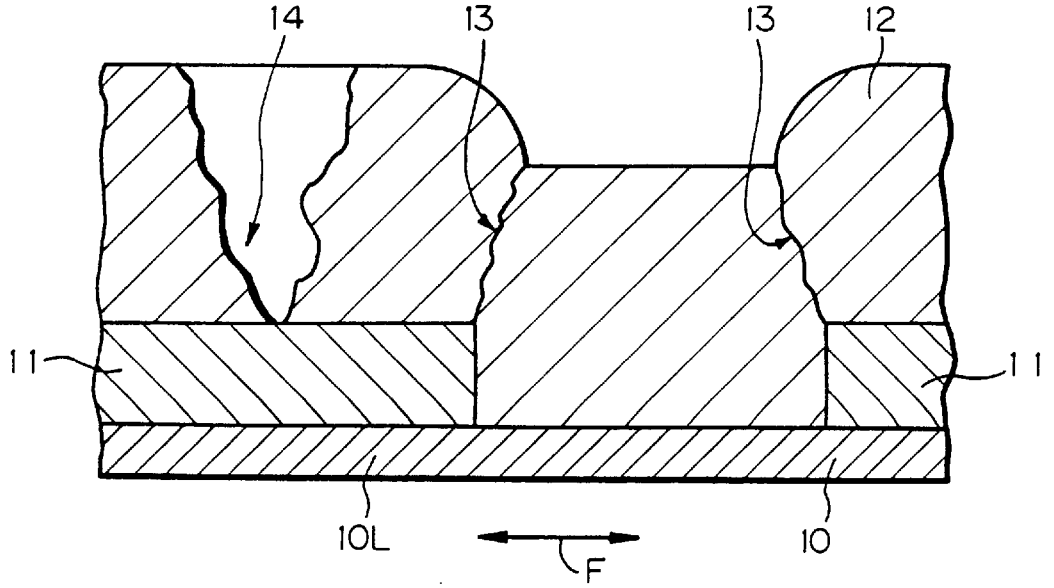
Fig. 4 PRIOR ART
FIG. 4 is an enlarged section along line SS13—SS13 of FIG. 4.

FIGS. 2 and 4 are sections showing a conventional structure of the surface portion of the head 5. As shown in FIG. 4, A1 lead electrodes 11 are formed on a resistance layer 10L forming heating elements. Cracks 13 occur in the stepped portions of a protection film 12, e.g., at the edges of the lead electrodes 11. Specifically, in the event of vacuum deposition of the protection film 12 forming a part of a procedure for producing the head 5, the cracks 13 occur in portions which are stepped even after the formation of the protection film 12 due to the influence of, e.g., the stepped edges of the lead electrodes 11.

Further, fine impurities deposit on the resistance body 10 or on the portions of the lead electrodes 11 adjoining the resistance body 10 before or after the formation of the protection film 12. When the impurities are peeled off from the protection film 12, they leave traces 14 in the form of pin holes. It is difficult with the state-of-the-art technologies to fully obviate the cracks 13 of the step coverage and the traces 14 of the impurities.

Moreover assume that some potential is left on the conductive platen roller 6, stencil 3 or paper 53 and head 5 after the operation and left there over a long period of time. Then, a current path is formed by the conductive platen roller 6, stencil 3 or paper 53, cracks 13 and traces 14 formed in the head, lead electrodes 11 and heating elements 10, causing a small current to flow therethrough. The current causes corrosive substances contained in the antistatic agent and adhesive of the stencil 3 or paper 53 to turn out corrosive ion products. The corrosive ion products are acceleratedly introduced into the head 5 via the cracks 13 and traces 14, corroding or oxidizing the lead electrodes It and heating elements 10. In the end the corrosion or oxidation makes the current supply to the heating elements 10 impracticable. As a result, despite the selective energization of the lead electrodes 11, the heating elements 10 cannot generate heat. An image formed in the stencil 3 or on the paper 53 in the above condition is defective, e.g., partly lost. Replacing the expensive head 5 is a burden on the user and is not desirable from the environment standpoint also.

Organic sulphonic metal salt or similar hygroscopic substance contained in the antistatic agent, as taught in Laid-Open publication No. 6-320700 mentioned earlier, contacts the protection film of the thermal head for moisture absorption. This eventually aggravates the corrosion of the lead electrodes and other constituents of the thermal head. Technologies of the kind described above are also taught in Japanese Patent Laid-Open Publication Nos. 8-99419 and 4-90374 by way of example.

The present invention capable of solving the problems discussed above will be outlined first hereinafter. A thermal recording device in accordance with the present invention includes a thermal head, a conductive platen roller, and moving means. The thermal head includes a plurality of heating elements or resistance bodies arranged in the main scanning direction. The heating elements, like the conventional heating elements, are selectively energized in accordance with an image signal so as to cause the recording side of a thermosensitive paper or similar thermosensitive recording medium to color. The thermal head may be implemented either by a planar line thermal head or a partial glaze thermal head. Each heating element may have any desired configuration, e.g., a rectangular configuration or a heat concentration type configuration.

The conductive platen roller has at least its circumferential surface formed of a conductive material. To surely release static electricity deposited on the platen roller, the platen roller should preferably be provided with a volume resistivity of less than $10^7$ Ω·cm inclusive; the effect increases with a decrease in volume resistivity. However, with the state-of-the-art technologies, only a conductive platen roller whose minimum volume resistivity is about $10^2$ Ω·cm is available. In such circumstances, it is particularly preferable that the volume resistivity of the platen roller be between $10^2$ Ω·cm and $10^5$ Ω·cm. The platen roller should preferably have its metallic core formed of highly conductive metal. The core is connected by lead to the ground portion of the device body, forming a current path.

Figure 3:
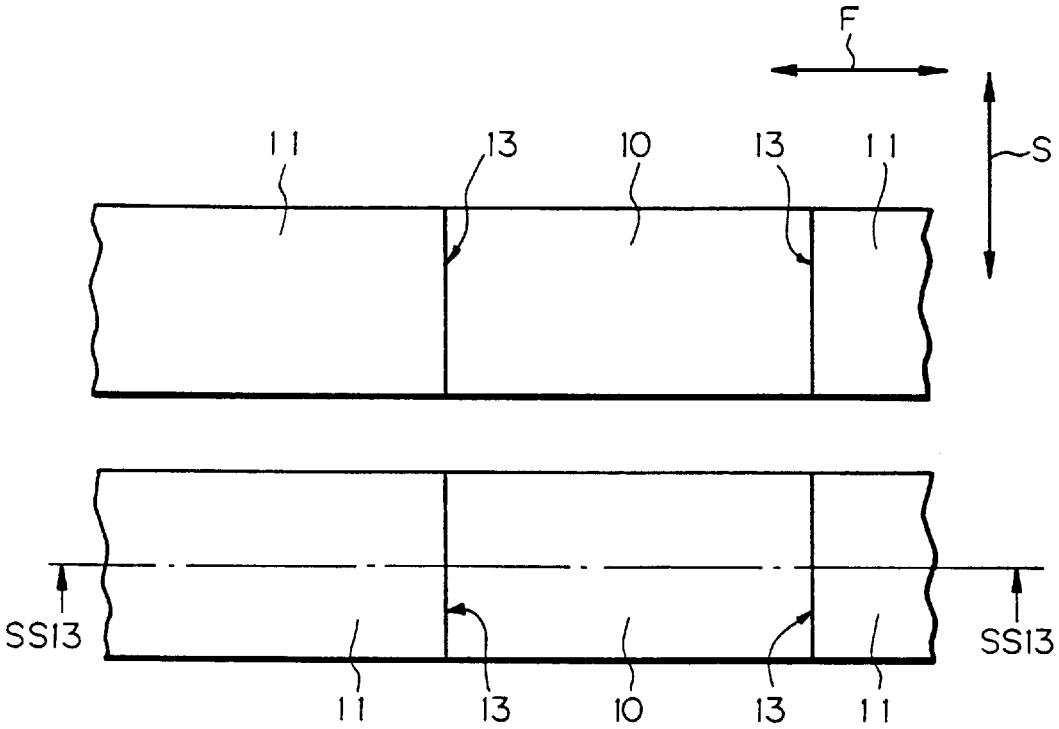
Fig. 3 PRIOR ART
FIG. 3 is a plan view showing the thermal head of FIG. 2 through a protection film.

The moving means is made up of a cam follower member carrying the thermal head thereon, a cam contacting the cam follower member, a DC motor, stepping motor or similar drive means for driving the cam, and biasing means for biasing the thermal head toward the conductive platen roller, as in a first and a third embodiment to be described later. However, this kind of moving means is only illustrative and may be replaced with any other suitable moving means so long as it is capable of moving the conductive platen roller and thermal head into and out of contact. Specific configurations of such moving means are disclosed in, e.g., FIGS. 1 and 3 of Japanese Patent Laid-Open Publication No. 4-371872, FIGS. 1 and 2 of Japanese Patent Laid-Open Publication No. 8-142444, and FIG. 1 of Japanese Patent Laid-Open Publication No. 9-11600.

To protect the thermal head from corrosion more positively and thereby extend the life of the head, there should preferably be provided control means for causing, during image recording operation, the moving means to bring the thermal head and conductive platen roller into contact via a thermosensitive paper or similar thermosensitive recording medium, but to release them from each other while the image recording operation is not under way.

The moving means may be replaced with an arrangement in which either one of the conductive platen roller and the heating elements of the thermal head is connected to ground via opening/closing means for opening or closing a current path. The opening/closing means may be implemented by a mechanical relay device having a contact or a semiconductor device, e.g., a photo MOS (Metal Oxide Semiconductor) relay.

To protect the thermal head from corrosion more positively and thereby extend the life of the head, there should preferably be provided control means for causing the opening/closing means to close the current path of the conductive platen roller or that of the heating elements during recording operation, but to open either one of the above current paths while the recording operation is not under way.

The present invention is applicable to all kinds of thermal recording devices having a thermal head and a platen roller and including a thermal image transfer type recording device using an ink sheet or similar thermal transfer medium.

A specific configuration of a thermal master making device in accordance with the present invention includes a thermal head, a conductive platen roller, and moving means. These structural elements will not be described specifically because they are basically identical with the corresponding elements of the above thermal recording device. As stated earlier, a thermosensitive stencil for a master making device is a assailable in various forms. A master consisting substantially only of a thermoplastic resin film may be used when images free from fiber marks are desired. It is to be noted that the stencil consisting substantially only of a thermoplastic resin refers not only to a stencil implemented only by a thermoplastic resin film, but also to a stencil whose thermoplastic resin film contains, e.g., a trace of antistatic agent and a stencil having one or more overcoat layers or similar thin layers on at least one side of a thermoplastic resin film. That is, the stencil or supply applicable to the present invention contains a corrosive substance corroding the lead electrodes of the thermal head. The corrosive substance is contained in at least one of a layer formed by a trace of antistatic agent applied to or impregnated in a thermoplastic resin film, a layer consisting of one or more overcoat layers or similar thin layers formed on one or both sides of the resin film, and an adhesive layer adhering a porous substrate to the resin film.

To protect the thermal head from corrosion more positively and thereby extend the life of the head, there should preferably be provided control means for causing the moving means to bring the conductive platen roller and stencil into contact during master making operation, but to release them from each other while the master making operation is not under way. Again, the moving means may be replaced with an arrangement in which either one of the conductive platen roller and the heating elements is connected to ground via opening/closing means for opening or closing a current path. The opening/closing means may be implemented by a mechanical relay device having a contact or a semiconductor device, e.g., a photo MOS relay.

To protect the thermal head from corrosion more positively and thereby extend the life of the head, there should preferably be provided control means for causing the opening/closing means to close the current path of the conductive platen roller or that of the heating elements during master making operation, but to open either one of the above current paths while the master making operation is not under way.

The various control means stated above are implemented by a microcomputer or a microprocessor.

Further, in each of the above thermal recording device and thermal master making device, both the moving means and the opening/closing means should preferably be provided and controlled by the respective control means in order to protect the thermal head from corrosion more positively and thereby extend the life of the ground.

Preferred embodiments of the present invention will be described hereinafter. In the illustrative embodiments, as well as in the conventional configurations, the structural elements identical in function or in configuration are designated by identical reference numerals, and a detailed description thereof will not be made in order to avoid redundancy. As for structural elements provided in pairs, only one of them will be described for the simplicity of description. A thermal master making device and a thermal recording device will be sequentially described in this order.

Figure 5:
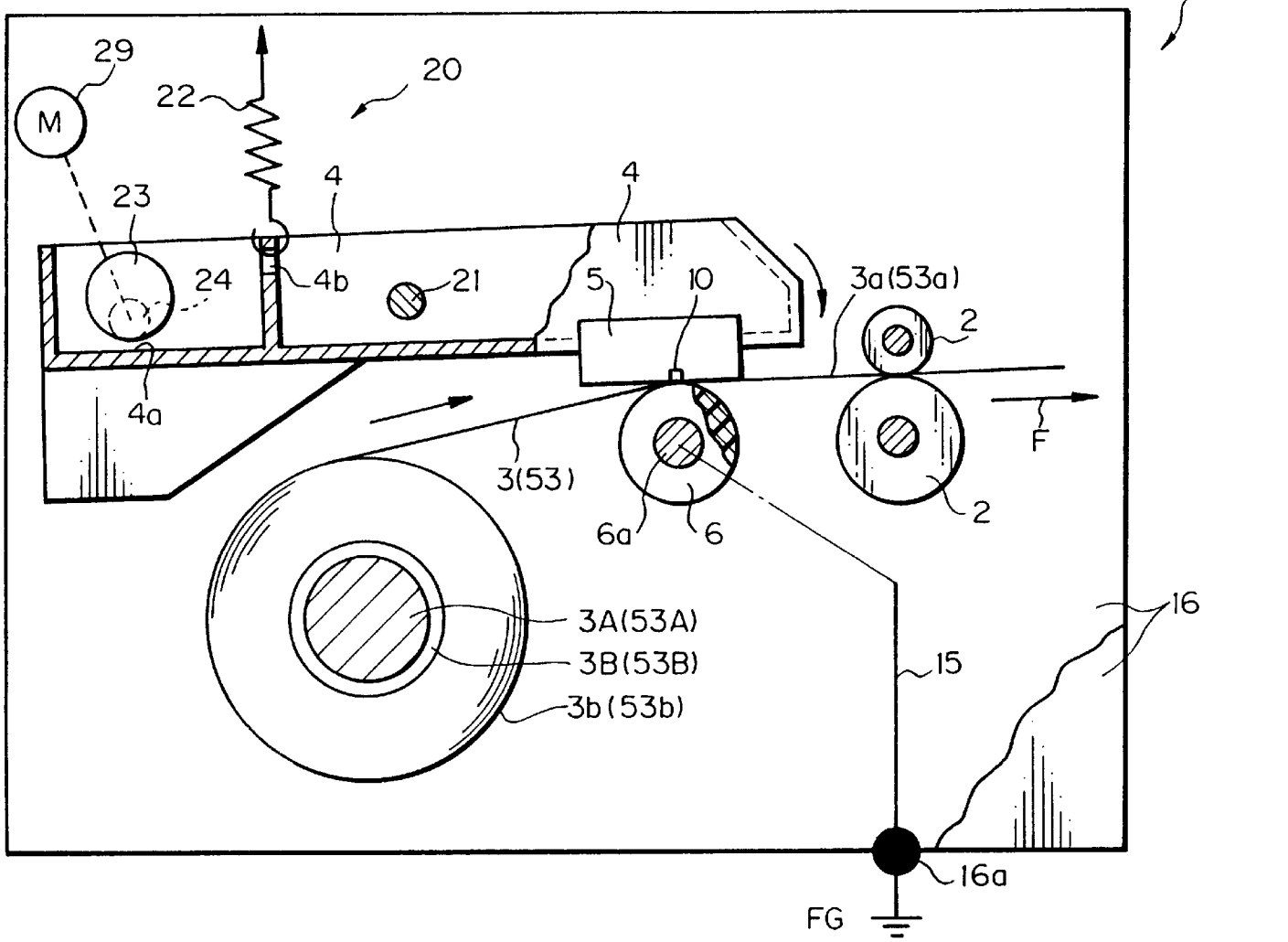
FIG. 5 is a fragmentary sectional front view showing a thermal master making device and a thermal recording device respectively representative of a first and a third embodiment of the present invention in a condition wherein a thermal head is held in contact with a conductive platen roller via a thermosensitive stencil or a thermosensitive paper.

Referring to FIG. 5, a thermal master making device representative of a first embodiment of the present invention is shown and generally designated by the reference numeral 1. The master making device 1 is applied to a digital printer using a stencil. Means other than the master making device 1, e.g., printing means, sheet feeding means, master discharging means and sheet discharging means included in a stencil printer or the like have been proposed in various forms in the past and will not be described specifically.

As shown in FIG. 5, the device 1 includes a stencil support member 3A, a thermal head 5, a conductive platen roller 6, a roller pair 2, and a pressure cancelling mechanism 20. Although the device 1 additionally includes a master cutting mechanism, a device for rotating the conductive platen roller 6 and/or the roller pair 2, and so forth, they are not shown for the better understanding of the illustrative embodiment.

A thermosensitive stencil 3 has a thermoplastic resin film 3*a* and is implemented as a roll 3*b* supported by the stencil support member 3A. The stencil 3 is paid out from t he roll 3*b*. The stencil support member 3A includes a brake rubber for exerting a preselected degree of tension on the stencil 3 being paid out from the roll 3*b*. Specifically, a tubular core 3B protrudes from the center of the roll 3*b* at both ends of the roll 3*b*. The stencil 3 is wound round the core 3B in the form of the roll 3*b*. In the illustrative embodiment, the stencil 3 is made up of the thermoplastic resin film 3*a* as thin as about 1 $\mu$m to 2 $\mu$m and formed of, e.g., polyester, and a porous substrate adhered to the film 3*a* and constituted by Japanese paper fibers, synthetic fibers or a combination thereof. The stencil 3 with such a laminate structure is selectively perforated, or cut, by heating elements 10 included in the head 5. A protection film 12, which will be described, is provided on the head 5 in order to protect the heating elements 10. Organic sulphonic metal salt or similar antistatic agent taught in, e.g., Japanese Patent Laid-Open Publication NO. 6-320700 is applied to the surface of the resin film 3*a* that contacts the protection film 12.

The stencil 3 for used in the device 1 may be replaced with the previously stated stencil consisting only of a thermoplastic resin film.

A pair of parallel side panels 16 forming a part of a casing are respectively positioned at the front and rear of the device 1, as viewed in the direction perpendicular to the sheet surface of FIG. 5. The side panels 16 are implemented by sheet metals. The master support member 3A is positioned between the side panels 16 while the core 3B of the roll 3*b* is rotatably and removably supported by the side walls 16.

The head 5 is positioned downstream of the master support member 3A in the direction of stencil conveyance. The heating elements 10 are arranged on the head 5 in the main scanning direction. The heating elements 10 are selectively energized in accordance with an image signal so as to perforate the resin film 3*a* of the stencil 3 by heating it. The pressure cancelling mechanism 20 brings the head 5 into or out of contact with the platen roller 6.

Reference will again be made to FIGS. 2 and 3 for 5 describing the structure of the head 5 in more detail. The head 5 included in the illustrative embodiment is a planar line thermal head. FIG. 2 is a section in the subscanning direction (direction of stencil transport) F perpendicular to the main scanning direction S. As shown, a base or heat radiator 7 formed of aluminum is positioned at the bottom of the head 5. A ceramic substrate 8 is formed on the base 7. A glass layer or glaze layer 9 is formed on the substrate 8 and 60 $\mu$m thick or less. A heating element layer or resistance layer 10L is formed on the glaze layer 9 and implemented by a tantalum-based resistance material. A1 lead electrodes It are formed on the heating element layer 10L. The previously mentioned protection layer 12 is formed on the lead electrodes 11, i.e., on the top of the head 5 in the conventional configuration. The protection layer 12 is implemented by a material belonging to an Si—O—N group. The heating elements 10 each refers to a rectangular portion surrounded by the A1 lead electrodes 11. When a voltage in the form of a pulse is applied between the lead electrodes 11, a current flows through the associated heating element 10 and has its electric energy transformed to thermal energy. As a result, the heating element 10 generates heat due to the Joule effect.

The cracks 13 and/or the traces 14 of impurities are apt to occur in the surface of the thermal head 5, as stated earlier with reference to FIG. 4.

The above materials constituting the head 5 are only illustrative and may be replaced with any other suitable materials. Also, the planar thermal head 5 may be replaced with a partial glaze type thermal head, if desired. In addition, the rectangular heating elements 10, as seen in a plan view, may be replaced with heat concentration type heating elements each being reduced in width at its intermediate portion; a current density increases at the intermediate portion and causes heat to concentrate there.

The platen roller 6 has its roller portion, including the circumferential surface, formed of conductive silicone rubber highly resistive to heat and wear and highly conductive. The platen roller 6 has a volume resistivity of $10^3$+$10^2$ Ω·cm. The core or shaft 6*a* of the platen roller 6 is formed of metal, e.g., SUM metal. However, these materials of the platen roller 6 are only illustrative and may be replaced with, e.g., synthetic rubber or plastics having the above volume resistivity and containing a conductive substance. The volume resistivity of the platen roller 6 should preferably be between $10^2$ Ω·cm and $10^5$ Ω·cm, as stated earlier.

Figure 6:
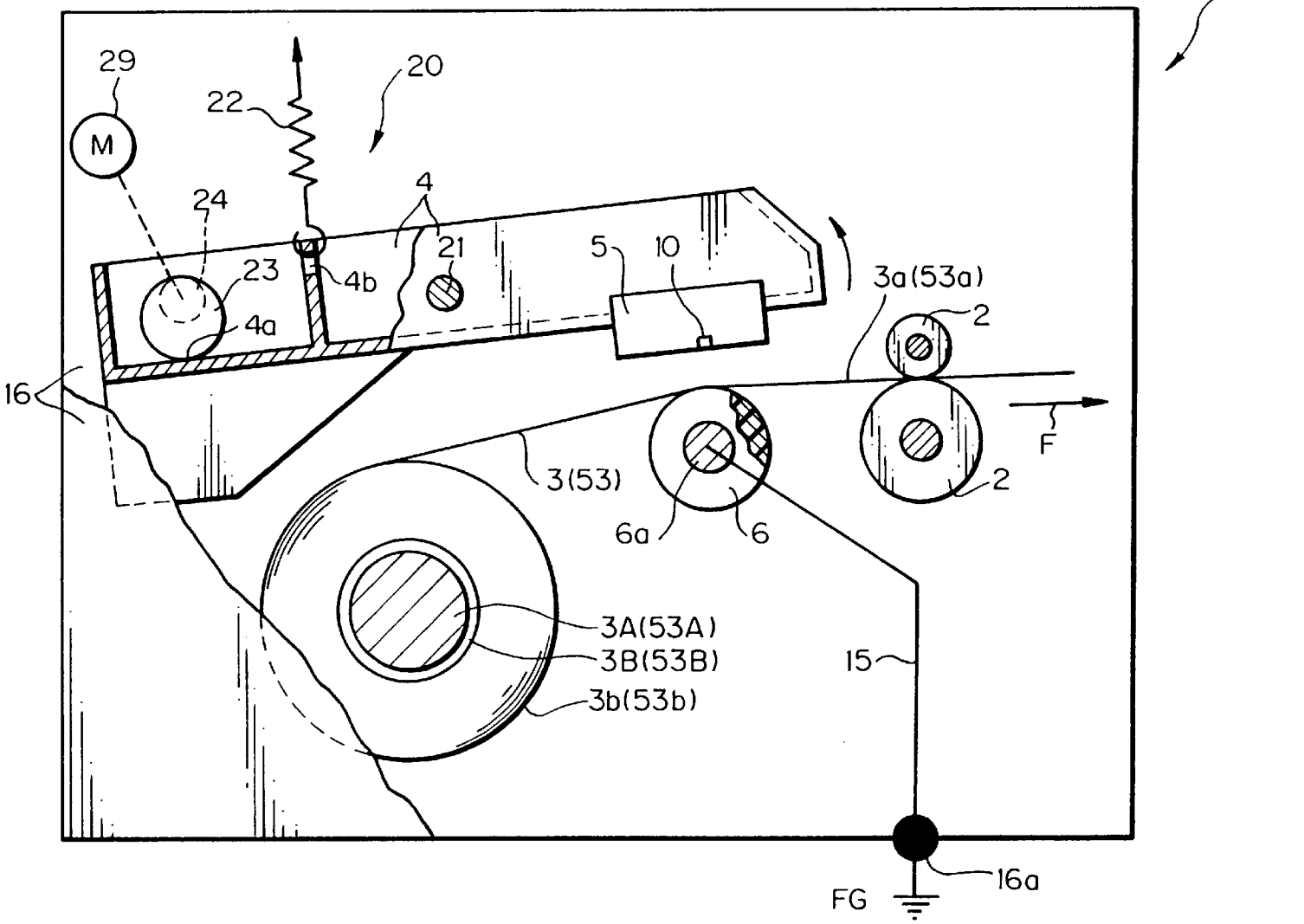
FIG. 6 shows a condition wherein the head is released from the platen roller.

As shown in FIG. 6, the platen roller 6 is journalled to the opposite side panels 16 via the core 6*a* and bearings, not shown. A lead 15 is electrically connected at one end to the core 6*a* and at the other end to a ground portion 16*a* included in the side panel pair 16. In this condition, an electric path allowing a current to flow therethrough extends from the periphery of the platen roller 6 to ground FG via the core 6*a*, lead 15, and ground portion 16*a*. The lead 15 is omissible if the above bearings are formed of a conductive material and connect the platen roller 6 to ground.

A stepping motor, not shown, is drivably connected to the platen roller 6 via a timing belt, pulleys, and so forth. The platen roller 6 driven by the stepping motor conveys the stencil 3 toward the downstream side in the subscanning direction F while pressing it against the head 5. The stepping motor and its associated elements constitute a driving device for conveying the stencil 3 in the above direction.

The roller pair 2 is located downstream of the platen roller 6 in the direction of stencil conveyance. The lower roller and upper roller of the roller pair 2 are a drive roller and a driven roller, respectively. The drive roller is connected to the above-mentioned stepping motor via a drive transmission mechanism, not shown. Each roller of the roller pair 2 is rotatable at a slightly higher peripheral speed than the platen roller 6.

Figure 7:
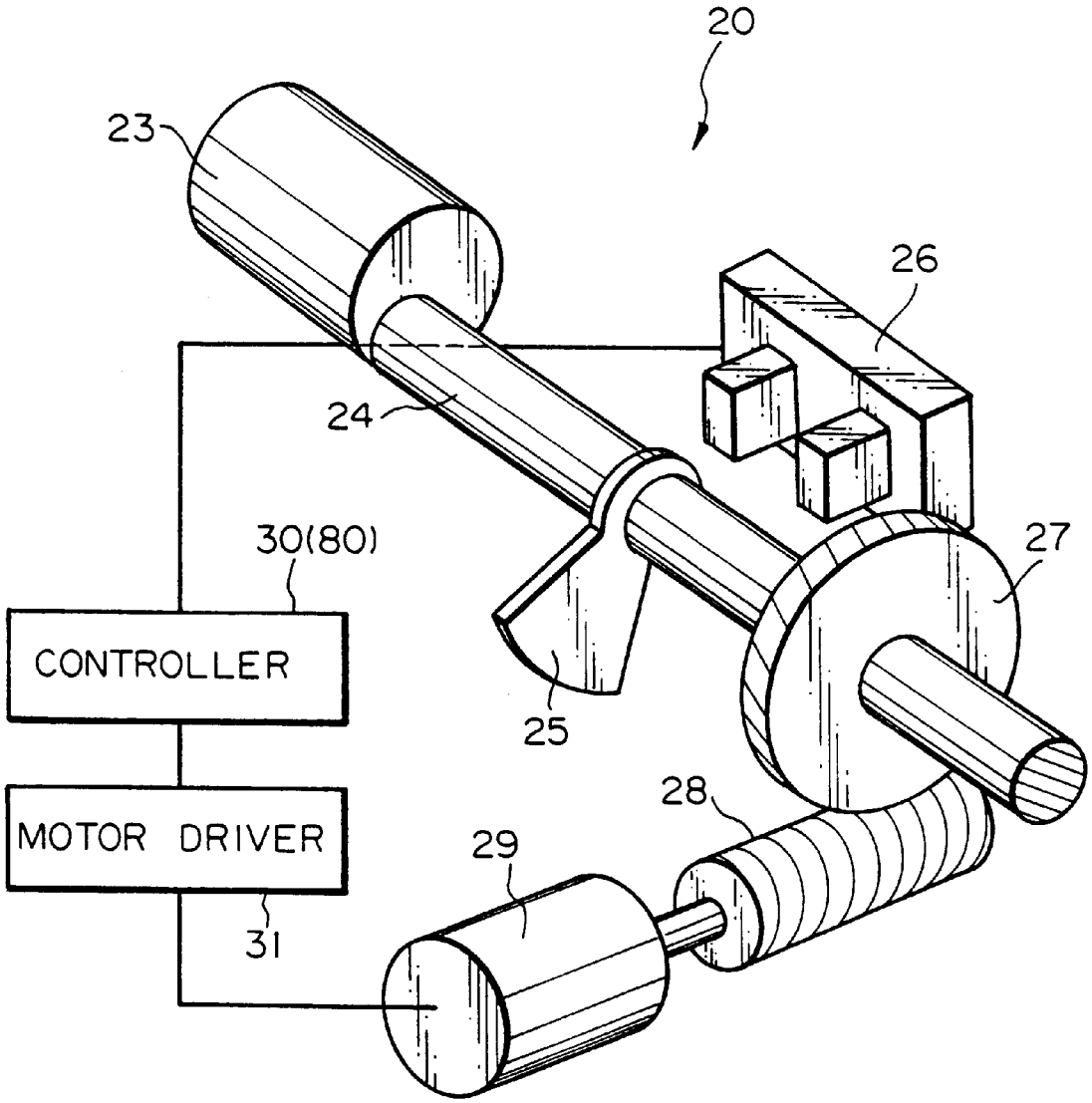
FIG. 7 is a perspective view showing a control arrangement included in each of the first and third embodiments.

The pressure cancelling mechanism, or moving means, 20 moves the head 5 and platen roller 6 into and out of contact with each other. As shown in FIGS. 5 and 7, the mechanism 20 is positioned above the master support member 3A and mainly constituted by a cam follower bracket 4, an eccentric cam 23, a cam shaft 24, a pair of tension springs 22, a worm 28, a worm wheel 27, and a motor 29.

As shown in FIGS. 5 and 6, the cam follower bracket 4 is implemented by a sheet metal having a box-like configuration which has its preselected portions reinforced. The bracket 4 is rotatably mounted on a shaft 21 at its intermediate portion. The shaft 21 is affixed to the opposite side panels 16. The head 5 is affixed to the right end portion of the bracket 4, as seen in FIGS. 5 and 6. A cam follower portion 4*a* is formed in the left end portion of the bracket 4, as seen in FIGS. 5 and 6, and capable of contacting the eccentric cam 23. The tension springs 22 each is anchored at one end to a hook portion 4*b* formed in the bracket 4 between the head affixing portion and the cam follower portion 4*a*. The other end of each tension spring 22 is anchored to a stationary member, not shown, affixed to the upper portions of the side panels 16. In this condition, the tension springs 22 constantly biases the head 5 clockwise, i.e., toward the platen roller 6, about the shaft 21. The cam follower portion 4*a* may be provided with a roller for reducing friction to act between it and the eccentric cam 23.

The eccentric cam 23 is positioned above and capable of contacting the cam follower portion 4*a*. When the cam 23 is brought into contact with the cam follower portion 4*a*, it causes the cam follower bracket 4 to rotate counterclockwise. As also shown in FIG. 7, the cam 23 is mounted on one end portion of the cam shaft 24 while the worm wheel 27 is mounted on the other end portion of the cam shaft 24. The end of the cam shaft 24 adjoining the worm wheel 27 is journalled to the rear side panel 16, as viewed in FIG. 5. A sectorial cam feeler 25 is mounted on the cam shaft 24 between the eccentric cam 23 and the worm wheel 27 and spreads over an angle of about 30° . The cam feeler 25 is positioned such that its sectorial portion is located at the smaller diameter side of the eccentric cam 23. A stationary member, not shown, is affixed to the rear side panel 16, as viewed in FIG. 5. A sensor 26 responsive to the contact and release of the head 5 from the platen roller 6 is mounted on the above stationary member and plays the role of contact/release sensing means. The sensor 26 is a conventional transmission type optical sensor made up of a light emitting element and a light-sensitive element. The light emitting element and light-sensitive element are so positioned as to sandwich the peripheral portion of the cam feeler 25 which is selectively rotated by the motor 29.

The motor 29 is mounted on the rear side panel 16, as viewed in FIG. 5, in the vicinity of the worm wheel 27. The motor 29 causes the eccentric cam 23 to rotate in order to cancel the pressure of the head 5 acting on the platen roller 6 via the stencil 3. The motor 29 may be implemented by a DC motor or a stepping motor by way of example. The worm 28 is mounted on the output shaft of the motor 29 and constantly held in mesh with the worm wheel 27.

The sensor 26 may, of course, be replaced with a magnetic or an optical encoder associated with the motor 29 for sensing the amount and direction of rotation of the motor 29. If desired, the pressure cancelling mechanism 20 may be replaced with a pressure cancelling mechanism of the kind selectively moving the platen roller 6 away from the head 5. Both of such two mechanisms may be used, neglecting the cost.

The operation of the pressure cancelling mechanism 20 and that of the sensor 26 will be described before the detailed description of operation of the illustrative embodiment. When the motor 29 is rotated, its rotation is transmitted to the eccentric cam 23 while having its rotation speed reduced and having its torque increased by the worm 28 and worm wheel 27. Specifically, as shown in FIG. 6, the motor 29 is rotated by a preselected amount toward its a pressure cancelling position (pressure OFF position hereinafter). This causes the eccentric cam 23 to rotate a preselected amount (half a rotation or 180° in this case) against the action of the tension springs 22, so that the larger diameter portion of the cam 23 is brought into contact with the cam follower portion 4*a* of the cam follower bracket 4. As a result, the motor 29 is rotated to its pressure OFF position. At the same time, the head 5 mounted on the right end portion of the bracket 4 is rotated counterclockwise about the shaft 21, cancelling its pressure acting on the platen roller 6. The cam feeler 25 is rotated into the gap between the light emitting element and the light-sensitive element of the sensor 26, intercepting light issuing from the light emitting element. Consequently, the sensor 26 is turned off and generates a release signal.

As shown in FIG. 6, the various structural elements stated above are positioned such that when the pressure of the head 5 is cancelled, the part of the stencil 3 existing on an imaginary line connecting the stencil pay-out portion of the roll 3*b* and the nip of the roller pair 2 is constantly positioned below the bottom of the head 5. Also, a preselected degree of braking force or tension constantly acts on the above part of the stencil 3. With the illustrative embodiment, therefore, it is possible to prevent the stencil 3 from slackening and contacting the surface of the head 5. This reduces the corrosion of the head 5 more positively.

On the other hand, as shown in FIG. 5, when the motor 29 is rotated toward its pressure position (pressure ON position hereinafter) by a preselected amount, the eccentric cam 23 is rotated by a preselected amount (half a rotation or 180° in this case) such that its smaller diameter portion faces the cam follower portion 4*a* of the bracket 4. As a result, the eccentric cam 23 is released from the cam follower portion 4*a*. The head 5 of the bracket 4 is rotated clockwise about the shaft 21 due to the action of the tension springs 22. The head 5 is therefore urged against the platen roller 6 by a preselected pressure. At this instant, the cam feeler 25 is rotated away from the sensor 26 with the result that the light issuing from the light emitting element of the sensor 26 is incident to the light-sensitive element. Consequently, the sensor 26 generates a contact signal in place of the release signal.

As stated above, in this embodiment including the pressure cancelling mechanism 20, the larger diameter portion of the eccentric cam 23 contacts the cam follower portion 4*a* only when the head 5 is spaced from the platen roller 6, i.e., when the pressure is cancelled. When the head 5 is held in contact with the platen roller 6 via the stencil 3, the small diameter portion of the cam 23 faces the cam follower portion 4*a*, but does not contact it. As a result, only the pressure derived from the bias of the tension springs 22 acts on the stencil 3 with accuracy.

A control system included in the illustrative embodiment will be described with reference to FIG. 7. As shown, the system has a controller 30 and a motor driver 31. The controller 30 receives a signal from a perforation start key, not shown, provided on an operation panel, not shown. The controller also receives ON/OFF signals from sensors and switches located at various drive sections to be controlled, and receives the release/contact signal or ON/OFF signal from the sensor 26. The controller 30 sends a command signal to the motor 29 of the pressure cancelling mechanism 20 via the motor driver 31. In addition, the controller 30 controls a system relating to the starts, stops and timings of the above drive sections.

The controller 30 has a microcomputer and includes a CPU (Central Processing Unit), an I/O (Input/Output) port, a ROM (Read Only Memory), a RAM (Random Access Memory), and so forth which are interconnected by a signal bus. The ROM stores a program and data for executing the operation of the device 1 which will be described later.

When the motor 29 is rotated to the pressure OFF position, i.e., when the pressure of the head 5 acting on the platen roller 6 is cancelled, the sensor 26 outputs the release signal or OFF signal and sends it to the controller 30. When the motor 29 is brought the pressure ON position, i.e., when the pressure of the head 5 acts on the platen roller 6, the sensor 26 outputs the contact signal or ON signal and sends it to the controller 30.

The controller 30 plays the role of control means for driving, during master making operation, the motor 29 to its pressure ON position via the motor driver 31 so as to bring the head 5 and platen roller 6 into contact via the stencil 3. While the master making operation is not under way, the controller or control means 30 drives the motor 29 to its pressure OFF position via the motor driver 31, thereby releasing the head 5 and platen roller 6 from each other.

Figure 8:
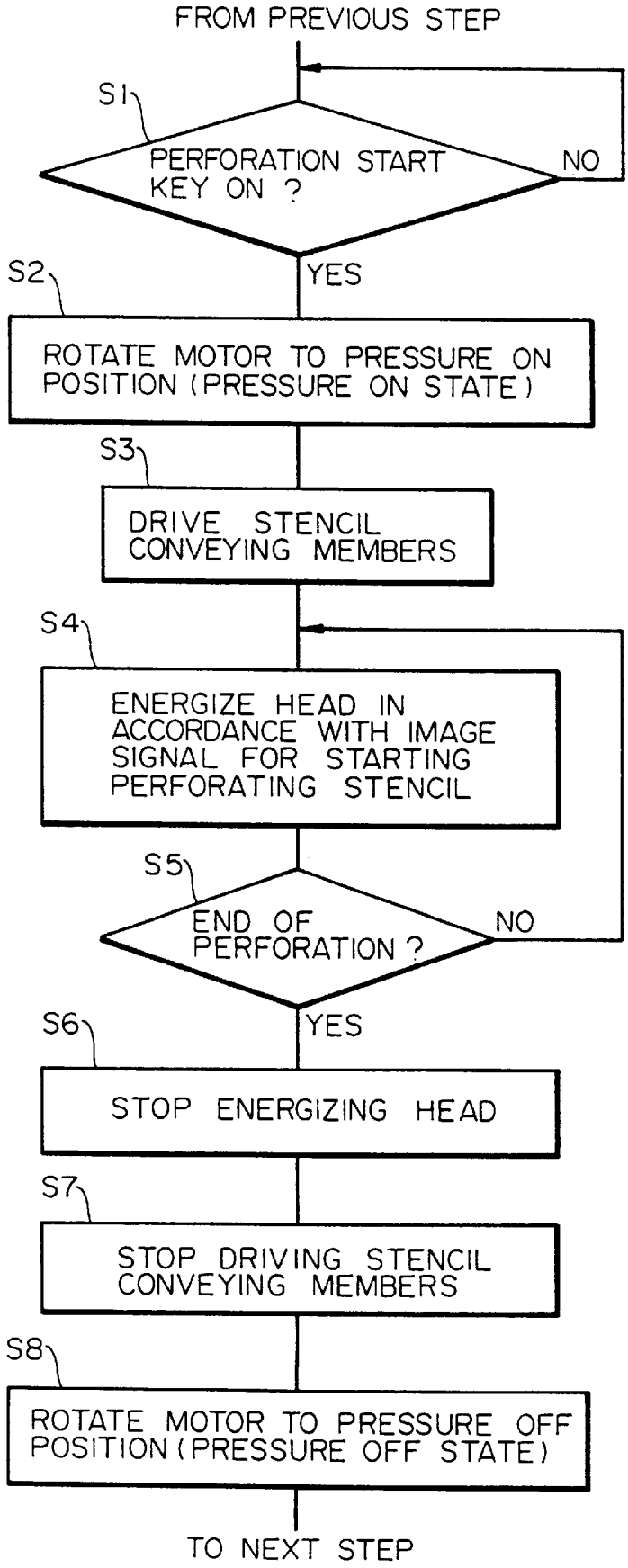
FIG. 8 is a flowchart demonstrating the operation of the first embodiment.

FIG. 8 is a flowchart demonstrating the general operation of the illustrative embodiment, i.e., controller 30. Details of the operation will be additionally described, as needed. As shown, the controller 30 determines whether or not the perforation start key is pressed (step S1). If the answer of the step S1 is positive (YES), the controller 30 drives the motor 29 to its pressure ON position via the motor driver 31 (step S2). As a result, the head 5 is brought into contact with the platen roller 6 via the stencil 3, setting up a pressure ON state. At the same time, the sensor 26 outputs the contact signal and sends it to the controller 30. Further, the head 5, stencil 3 and platen roller 6 are connected to ground FG via the lead 15 and ground portion 16*a*. If the answer of the step S1 is negative (NO), the procedure returns.

As soon as the motor 29 reaches its pressure ON position, the controller 30 causes the stepping motor connected to the platen roller 6 and other driving devices to start rotating (step S3). As a result, the platen roller 6 and roller pair 2 are caused to rotate, conveying the stencil 3 in the subscanning direction F. A master making operation starts in a step S4. Specifically, in the step S4, the heating elements 10 of the head 5 selectively generate heat in accordance with an image signal and thereby perforate the resin film 3*a* of the stencil 3 facing the heating elements 10. Consequently, a dot image is formed in the part of the stencil 3 intervening between the platen roller 6 and the head 5. In this case, the head 5 is urged against the platen roller 6, and the head 5, stencil 3 and platen roller 6 are connected to ground FG via the lead 15 and ground portion 16*a*, as stated above. Therefore, static electricity deposited on, e.g., the stencil 3 is released from the periphery of the platen roller 6, where the potential difference is small, to ground FG via the core 6*a*, lead 15, and ground portion 16*a*.

Subsequently, the controller 30 determines whether or not the master making operation has ended (step S5). This decision may be made on the basis of whether or not a preselected period of time has elapsed since the disappearance of the image signal or whether or not all the documents stacked on a tray, not shown, have been fed. If the answer of the step S5 is NO, the procedure returns to the step S4.

If the answer of the step S5 is YES, the controller 30 causes the energization of the head 5 to be stopped (step S6). Subsequently, the controller 30 turns off the stepping motor and other driving devices (step S7). Consequently, the platen roller 6 and roller pair 2 are brought to a stop, so that the conveyance of the stencil 3 is stopped.

After the step S7, the controller 30 drives the motor 29 to its pressure OFF position via the motor driver 31 (step S8). The head 5 is therefore released from the platen roller 6, setting up a pressure OFF state. At the same time, the sensor 26 generates the release signal and sends it to the controller 30. Because the head 5 is released from the master 3 and platen roller 6, it is disconnected from ground (insulated) despite the presence of the stencil 3, platen roller 6, lead 15, and ground portion 16*a*.

In this manner, during master making operation, static electricity deposited on, e.g., the stencil 3 is released from the periphery of the platen roller 6, where the potential difference is small, to ground FG via the core 6*a*, lead 15, and ground portion 16*a*. In addition, static electricity to remain on the periphery of the platen roller 6 and that of the head 5 can be noticeably reduced. After the master making operation has ended, the head 5 is released from the platen roller 6. In this condition, a current path ascribable to the platen roller 6, stencil 3, and cracks 13 and traces 14 of impurities formed in the surface of the head 5 is interrupted. In addition, there can be obviated a small current tending to flow through the current path due to the potentials of the stencil 3, platen roller 6, and so forth.

Particularly, when the head 5 is released from the platen roller 6, the pressure cancelling mechanism 20 maintains the head 5 spaced from the stencil 3 containing corrosive substances. This reduces the corrosion of the head 5 more effectively, compared to the case wherein the head 5 and platen roller 6 are released with the stencil 3 adhering to the head 5.

Further, because the pressure is cancelled with the head 5 being released from the stencil 3 and platen roller 6, there can be obviated an occurrence that the stencil 3 adheres to the platen roller 6 or the platen roller 6 deforms due to aging and/or varying environmental conditions.

This embodiment obviates the problem ascribable to the corrosive substances contained in one or more of the layers formed on the resin film 3*a* and discussed earlier in relation to the conventional structure. It is therefore possible to reduce the corrosion of the expensive head 5 in any environment while ensuring the desirable conveyance of the stencil 3, thereby reducing defective images. The embodiment reduces the burden on the user and extends the life of the head 5. Extending the life of the head 5 is desirable from the environment standpoint.

When the stencil 3 is conveyed without the master making operation being performed, the pressure of the head 5 may be caused to act on the platen roller 6, i.e., connected to ground FG via the ground portion 16*a*. Alternatively, before or after the master making operation, the pressure of the head 5 may be cancelled, i.e., disconnected from ground FG in order to correct the creasing or skewing of the stencil 3.

Figure 9:
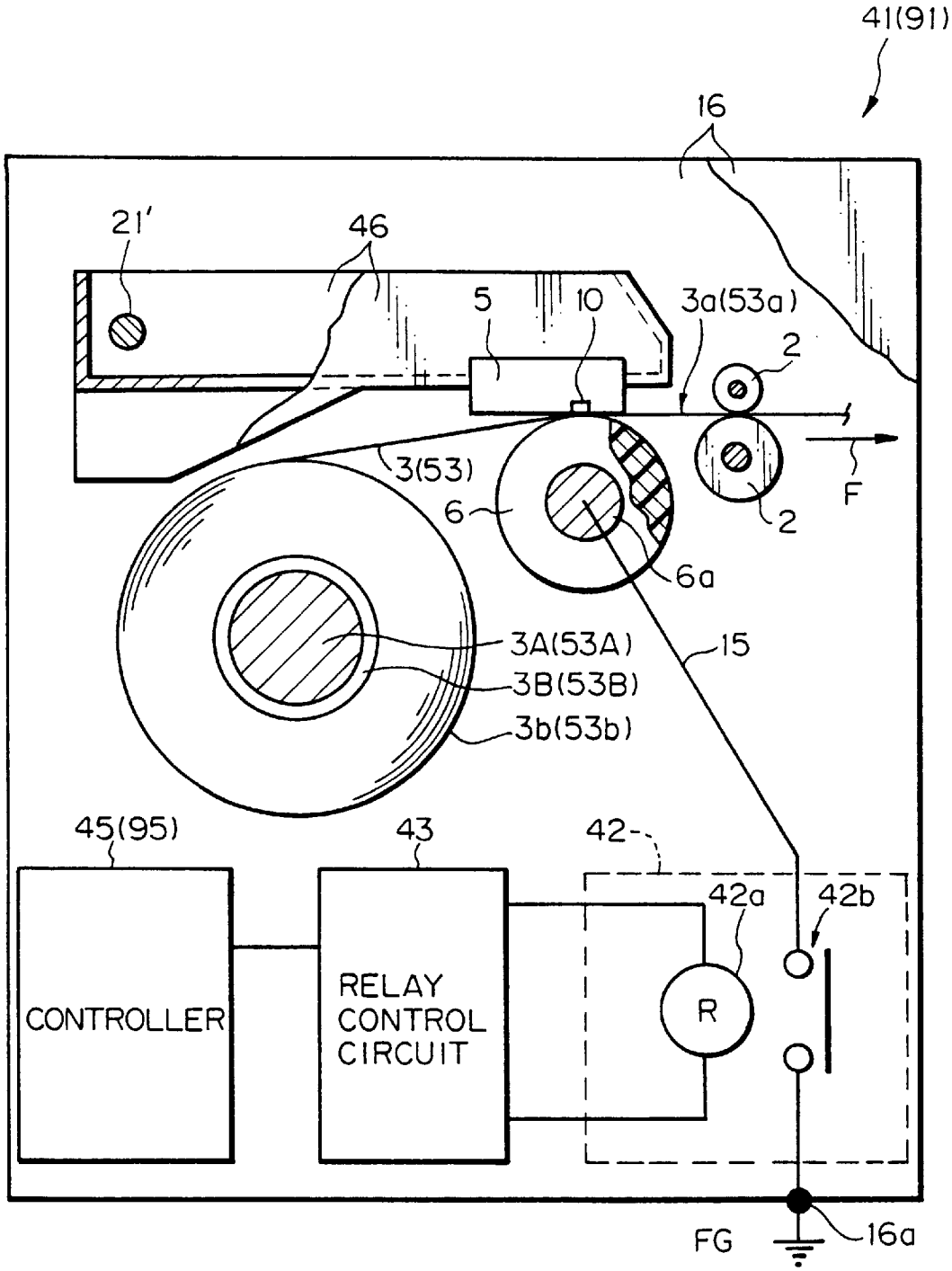
FIG. 9 is a fragmentary sectional front view showing a thermal master making device and a thermal recording device respectively representative of a second and a fourth embodiment of the present invention in a condition wherein a current circuit is opened.
Figure 10:
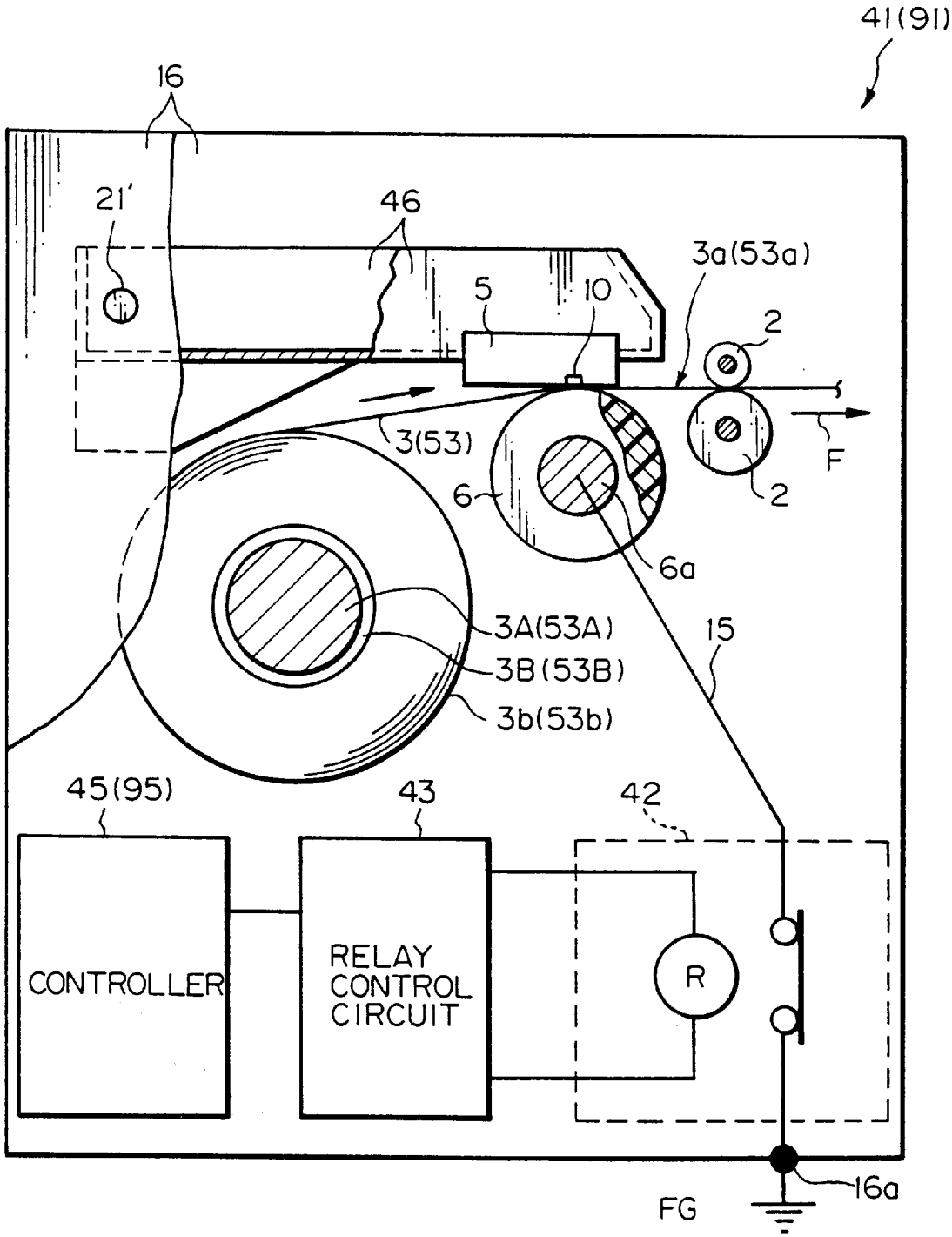
FIG. 10 shows a condition wherein the current circuit is closed.
Figure 11:
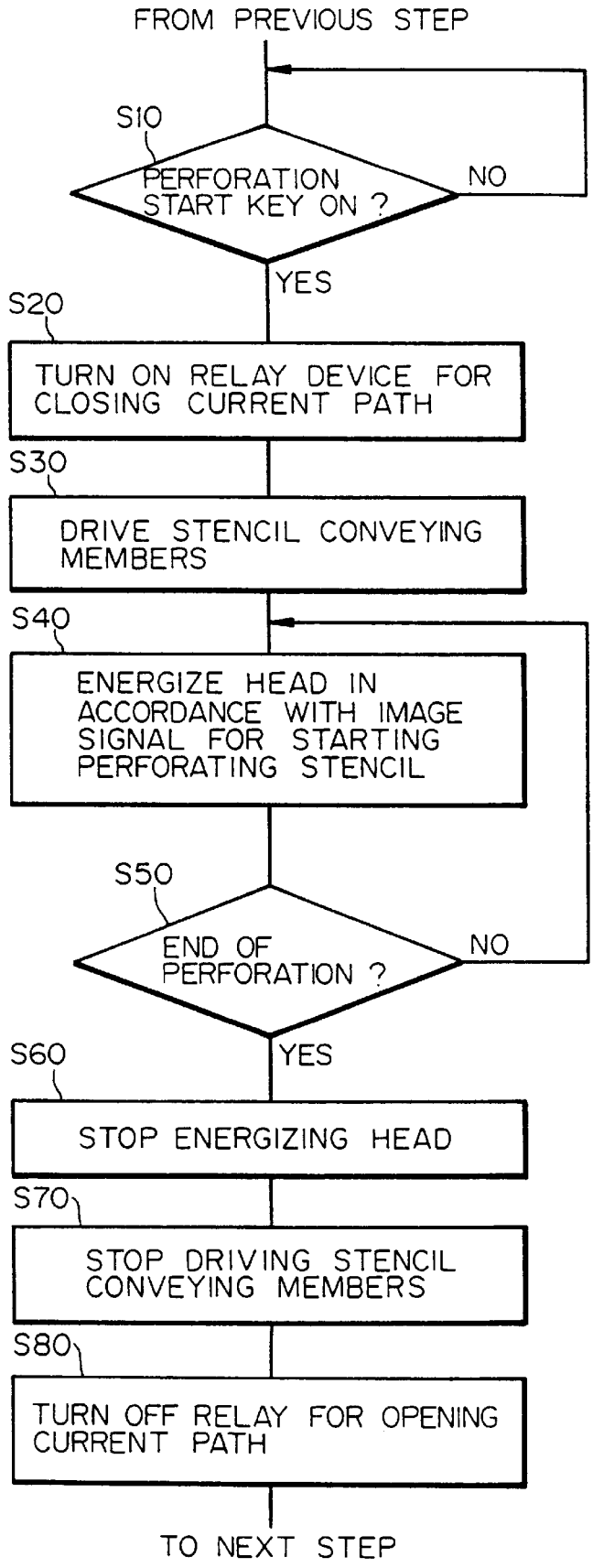
FIGS. 11–13 are flowcharts respectively showing the operations of the second to fourth embodiments.

Referring to FIGS. 9–11, a thermal master making device representative of a second embodiment of the present invention will be described. As shown in FIG. 9, the master making device, generally 41, is similar to the master making device 1 except for the following. The pressure cancelling mechanism 20 is replaced with a relay device (electromagnetic relay) 42 via which the conductive platen roller 6 is connected to ground FG. The relay device 42 plays the role of the opening/closing means for selectively opening or closing the current path. The cam follower bracket 4 is replaced with a head support member 46 having a modified internal structure and a modified rotating mechanism. In addition, the controller 30 is replaced with a controller 45.

Specifically, the controller 45 feeds to a relay control circuit 43 an ON command for turning on the relay device 42 or an OFF command for turning it off. In response to the ON command, the relay control circuit 43 causes a current to flow to a coil 42*a* included in the relay device 42 via a power source, not shown, thereby closing (ON) a contact 42*b*. In response to the OFF command, the relay control circuit 43 shuts off the above current in order to deenergize the coil 42*a*, thereby opening (OFF) the contact 42*b*. The relay device 42, indicated by a phantom line, selectively opens or closes the current path extending from the platen roller 6 to ground FG via the core 6*a* and lead 15.

The mechanical relay device 42 having a contact and playing the role of the opening/closing means may be replaced with a photo MOS relay implemented by a contactless semiconductor device, an SSR (Solid State Relay) or the like.

The head support member 46, like the cam follower bracket 4 of the previous embodiment, is implemented by a sheet metal and provided with a box-like configuration having preselected portions thereof reinforced. The left end portion of the head support member 46 is rotatably mounted on a shaft 21' at its center. The shaft 21' is affixed to the opposite side panels 16. A coil spring, not shown, is wound round the shaft 21' and constantly biases the head support member 46 clockwise, i.e., toward the platen roller 6. The head 5 is mounted on the right end portion of the head support member 46.

The controller 45 receives a signal from a perforation start key, receives ON/OFF signals from sensors and switches associated with various drive sections to be controlled, and sends the ON/OFF command to the relay device 42 via the relay control circuit 43. In addition, the controller 45 controls the system relating to the starts, stops and timings of the drive sections to be controlled.

The controller 45 has a microcomputer and includes a CPU, an I/O port, a ROM, a RAM, and so forth which are interconnected by a signal bus. The ROM stores a program and data for executing the operation of the device 41 which will be described later.

The controller 45 plays the role of control means for causing, during master making operation, the relay device 42 to close the current path connected to the platen roller 6 via the relay control circuit 43. While the master making operation is not under way, the controller or control means 4 5 causes the relay device 42 to open the above current path via the relay control circuit 43.

Figure 14:
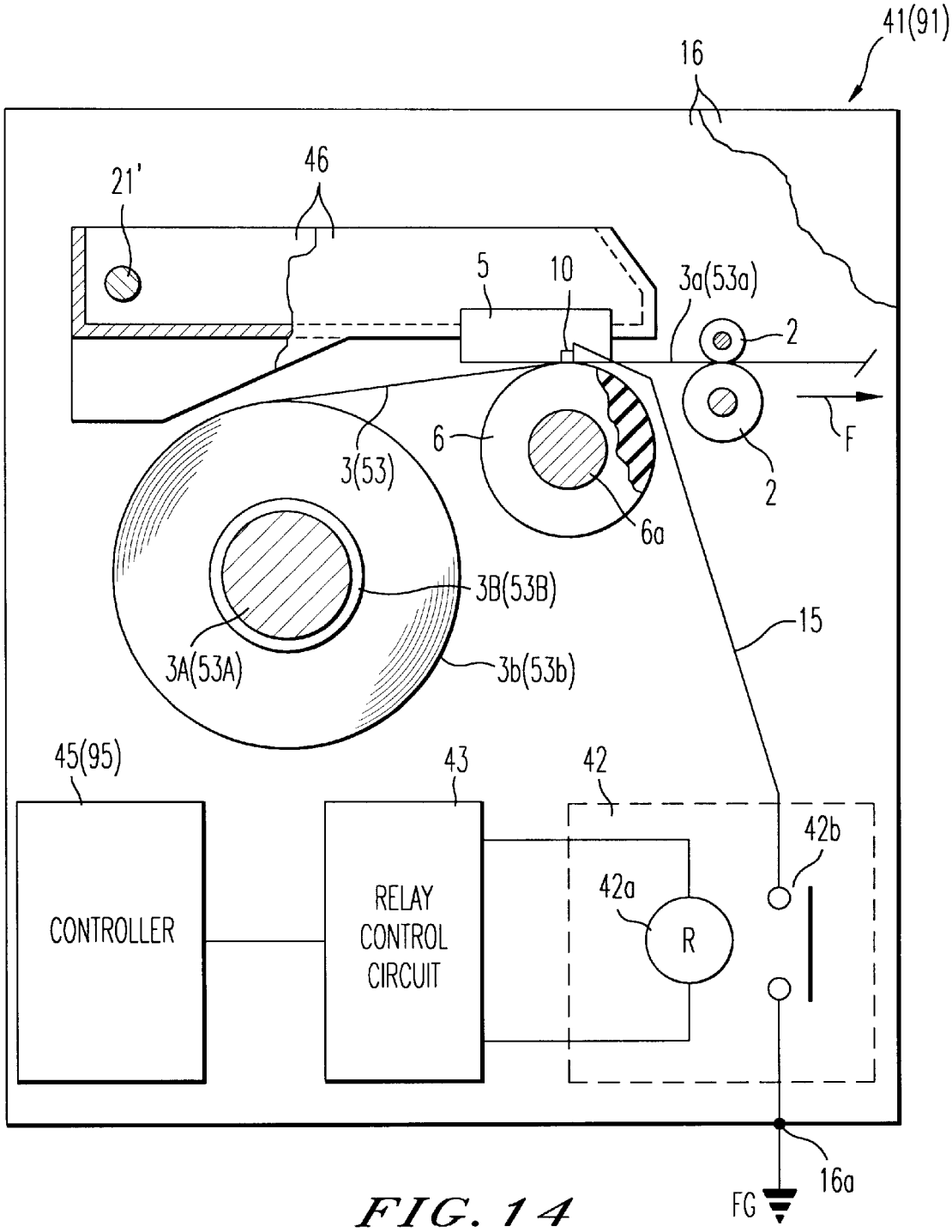
FIG. 14 is a fragmentary sectional front view showing a variation of the embodiment of FIG. 9.

FIG. 14 shows a variation of the embodiment of FIG. 9 where lead 15 is connected to the heating elements 10 rather than the roller. This ground connection operates in the same manner since it is in the same electrical path.

FIG. 11 is a flowchart demonstrating the general operation of the illustrative embodiment, i.e., controller 45. Again, details of the operation will be additionally described, as needed. As shown, the controller 45 determines whether or not the perforation start key on the operation panel is pressed (step S10). If the answer of the step S10 is YES, the controller 45 delivers the ON command to the relay control circuit 43 for thereby energizing (ON) the relay device 42 (step S20). As a result, the relay device 42 is turned on (see FIG. 10), closing the current path connected to the platen roller 6. Consequently, the head 5, stencil 3 and platen roller 6 are connected to ground FG via the lead 15 and ground portion 16*a*. If the answer of the step 510 is NO, the procedure returns.

As soon as the relay device 42 is turned on via the relay control circuit 43, the controller 45 causes the stepping motor connected to the platen roller 6 and other driving devices to start rotating (step S30). As a result, the platen roller 6 and roller pair 2 are caused to rotate, conveying the stencil 3 in the subscanning direction F. A master making operation starts in a step S40. Specifically, in the step S40, the heating elements 10 of the head 5 selectively generate heat in accordance with an image signal and thereby perforate the resin film 3*a* of the stencil 3 facing the heating elements 10. Consequently, a dot image is formed in the part of the stencil 3 intervening between the platen roller 6 and the head 5. In this case, the relay device 42 is turned on to close the current path connected to the platen roller 6, and the roller 6 is connected to ground FG via the lead 15 and ground portion 16*a*. Therefore, static electricity deposited on the platen roller 6 during the conveyance of the stencil 3 is released to ground FG via the core 6*a*, lead 15, and ground portion 16*a*.

Subsequently, the controller 45 determines whether or not the master making operation has ended (step S50). Again, this decision may be made on the basis of whether or not a preselected period of time has elapsed since the disappearance of the image signal or whether or not all the documents stacked on a tray, not shown, have been fed. If the answer of the step S50 is NO, the procedure returns to the step S40.

If the answer of the step S50 is YES, the controller 45 causes the energization of the head 5 to be stopped (step S60). Subsequently, the controller 45 turns off the stepping motor and other driving devices (step S70). Consequently, the platen roller 6 and roller pair 2 are brought to a stop, so that the conveyance of the stencil 3 is stopped.

After the step S70, the controller 45 delivers the OFF command to the relay control circuit 43 in order to turn off the relay device 42 (step S80). As a result, the relay device 42 is turned off (see FIG. 9). Consequently, the current path connected to the platen roller 6 is opened. More specifically, the current path extending from the head 5 to the lead 15 via the stencil 3 and platen roller 6 and the current path extending from the ground portion 16*a* to ground FG are opened. Therefore, the head 5 is disconnected from ground (insulated) despite the presence of the stencil 3, platen roller 6, lead 15.

In this manner, during master making operation, static electricity deposited on, e.g., the stencil 3 during conveyance is released from the periphery of the platen roller 6, where the potential difference is small, to ground FG via the core 6*a*, lead 15, and ground portion 16*a*. In addition, static electricity to remain on the periphery of the platen roller 6 and that of the head 5 can be noticeably reduced. After the master making operation has ended, the current path formed by the platen roller 6, stencil 3, cracks 13 or the traces 14 of impurities, lead electrodes 11 and heating elements 10 is interrupted. In addition, a small current is prevented from flowing through the above current path due to a potential deposited on, e.g., the stencil 3 or the platen roller 6.

This embodiment also obviates the problem ascribable to the corrosive substances contained in one or more of the layers formed on the resin film 3*a* and discussed earlier in relation to the conventional structure. It is therefore possible to reduce the corrosion of the expensive head 5 in any environment while ensuring the desirable conveyance of the stencil 3, thereby reducing defective images. The embodiment reduces the burden on the user and extends the life of the head 5. Extending the life of the head 5 is desirable from the environment standpoint.

If desired, the pressure cancelling mechanism 20 and controller 30 included in the first embodiment may be added to the configuration described above. The illustrative embodiment may included manual holding means for holding, when the device 41 is expected to be left unused over a long period of time, the head 5 of the head support member 46 in the position spaced from the platen roller 6. In such a case, the various structural elements of the device 41 will be positioned such that the portion of the stencil 3 existing on the imaginary line connecting the master pay-out position of the roll 3*b* and the nip of the roller pair 2 is constantly positioned below the bottom of the head 5, while a preselected degree of braking force or tension will be constantly applied to the above portion of the stencil 3. With the manual holding means, it is possible to maintain the head 5 spaced from the platen roller 6 and thereby prevent the stencil 3 from slackening and contacting the surface of the head 5. This reduces the corrosion of the head 5 more positively.

In this embodiment, the platen roller 6 is connected to ground FG via the relay device or opening/closing means 42. Alternatively, the heating elements 10 of the head 5 may be connected to ground FG via the relay device 42 which opens and closes the current path extending from the head 5 to ground FG, in which case the controller 45 will also execute the procedure described previously. The heating elements 10 may be connected to ground FG either directly or by way of the lead electrodes 11 connected to the heating elements 10.

A thermal recording device representative of a third embodiment of the present invention will be described w it h reference to FIGS. 5–7 and 12. In FIGS. 5 and 6, the thermal recording device and a thermosensitive paper or similar thermosensitive recording medium are respectively designated by the parenthesized reference numerals 51 and 53 in distinction from the thermal master making device 1 and stencil 3. The third embodiment is identical with the first embodiment in that the thermal head 5 and conductive platen roller 6 each having the previously stated configuration are used. In the third embodiment, the head 5 thermally records, or prints, an image on the paper 53 different from the stencil 3. Because the third embodiment shares many of the structural elements with the first embodiment except for the supply and the control system, the former will be described with reference to the same drawings as the latter.

The device 51 is applicable to all kinds of printing devices using the thermosensitive paper 53 and including the printing section of a facsimile apparatus and that of a word processor. Only arrangements common to such printing devices will be described because each kind of printing device has a particular structure.

The head 5, platen roller 6, roller pair 2 and pressure cancelling mechanism 20 also included in the recording device 51 will not be described specifically in order to avoid redundancy. The recording device 51 additionally includes a mechanism for cutting the paper 53 and a device for rotating the platen roller 6 and/or the roller pair 2 for driving the paper 53 in the subscanning direction F, although not shown specifically. Hereinafter will be described the paper 53, a paper support member 53A relating to the paper 53, and an arrangement around the head 5.

The paper support member 53A supports a paper roll 53*b* such that the paper 53 can be paid out from the roll 53*b*. The paper 53 has a thermosensitive recording surface 53*a*.

A tubular core 53B protrudes from the center of the paper roll 53*b* at both ends of the roll 53*b*. The paper 53 is wound round the core 53B, forming the roll 53*b*. The paper 53 may be implemented by a base material coated with a coloring agent which colors when subjected to heat. The heating elements 10 of the head 5 are selectively energized to heat the paper 53 and thereby print an image on the paper 53. An overcoat layer is formed on the side of the recording surface 53*a* of the paper 53 that will contact the protection layer 12 of the head 5. A tetraammonium salt type or similar antistatic agent is applied to the overcoat layer.

The head 5 is positioned downstream of the paper support member 53A in the direction of paper transport. While the paper 53 is paid out from the roll 53*b*, the head 5 has its heating elements 10 selectively energized in accordance with an image signal. As a result, the recording surface 53*a* of the paper 53 selectively colors so as to form an image represented by the image signal. The pressure cancelling mechanism 20 selectively moves the head 5 into or out of contact with the platen roller 6.

A control system included in the device 51 will be described with reference to FIG. 7. As shown, the system has a controller 80. The controller 80 receives a signal from a print start key, not shown, provided on an operation panel and the release/contact signal or ON/OFF signal from the sensor 26, while sending a command signal to the motor 29 of the pressure cancelling mechanism 20 via the motor driver 31. In addition, the controller 80 controls the system relating to the starts, stops and timings of the drive sections to be controlled.

The controller 80 also has a microcomputer and includes a CPU, an I/O port, a ROM, a RAM, and so forth which are interconnected by a signal bus. The ROM stores a program and data for executing the operation of the recording device 51 which will be described later.

When the motor 29 is rotated to the pressure OFF position, i.e., when the pressure of the head 5 acting on the platen roller 6 is cancelled, the sensor 26 outputs the release signal or OFF signal and sends it to the controller 80. When the motor 29 is brought its pressure ON position, i.e., when the pressure of the head 5 acts on the platen roller 6, the sensor 26 outputs the contact signal or ON signal and sends it to the controller 80.

The controller 80 plays the role of control means for driving, during recording or printing operation, the motor 29 to its pressure ON position via the motor driver 31 so as to bring the head 5 and platen roller 6 into contact via the paper 53. While the recording operation is not under way, the controller or control means 80 drives the motor 29 to its pressure OFF position via the motor driver 31, thereby releasing the head 5 and platen roller 6 from each other.

Figure 12:
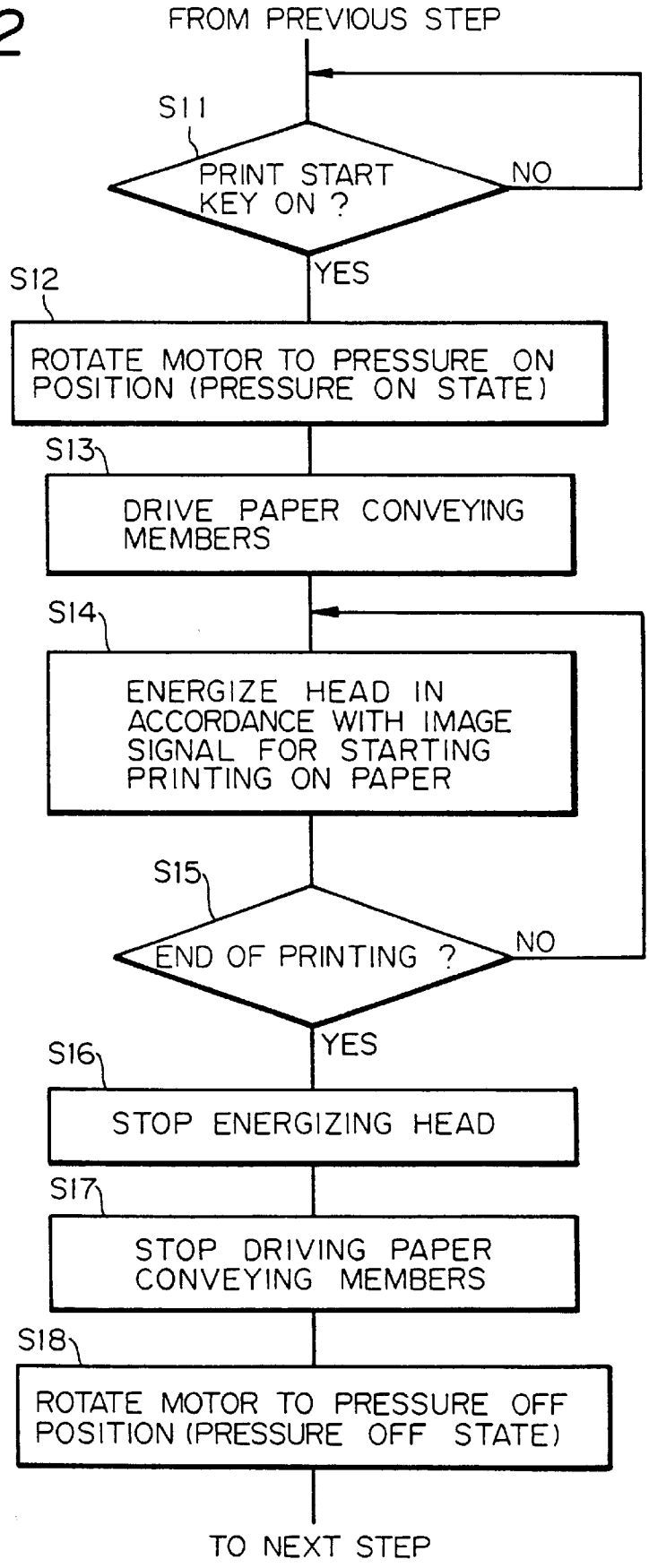

FIG. 12 is a flowchart demonstrating the general operation of the device 51, i.e., controller 80. Details of the operation will be additionally described, as needed. As shown, the controller 80 determines whether or not the print start key is pressed (step S11). If the answer of the step S11 is YES, the controller 80 drives the motor 29 to its pressure ON position via the motor driver 31 (step S12). As a result, the head 5 is brought into contact with the platen roller 6 via the paper 53, stetting up a pressure ON state. At the same time, the sensor 26 outputs the contact signal and sends it to the controller 80. Further, the head 5, paper 53 and platen roller 6 are connected to ground FG via the lead 15 and ground portion 16*a*. If the answer of the step S11 is NO, the procedure returns.

As soon as the motor 29 reaches its pressure ON position, the controller 80 causes the stepping motor connected to the platen roller 6 and other driving devices to start rotating (step S13). As a result, the platen roller 6 and roller pair 2 are caused to rotate, conveying the paper 53 in the subscanning direction F. A printing operation starts in a step S14. Specifically, in the step S14, the heating elements 10 of the head 5 selectively generate heat in accordance with an image signal and thereby cause the recording surface 53*a* of the paper 53 to color. Consequently, a dot image is formed on the part of the paper 53 intervening between the platen roller 6 and the head 5. In this case, the head 5 is urged against the platen roller 6, and the head 5, paper 53 and platen roller 6 are connected to ground FG via the lead 15 and ground portion 16*a*, as stated above. Therefore, static electricity deposited on, e.g., the paper 53 is released from the periphery of the platen roller 6, where the potential difference is small, to ground FG via the core 6*a*, lead 15, and ground portion 16*a*.

Subsequently, the controller 80 determines whether or not the printing operation has ended (step S15). This decision may also be made on the basis of whether or not a preselected period of time has elapsed since the disappearance of the image signal or whether or not all the documents stacked on a tray, not shown, have been fed. If the answer of the step S15 is NO, the procedure returns to the step S14.

If the answer of the step S15 is YES, the controller 80 causes the energization of the head 5 to be stopped (step S16). Subsequently, the controller 80 turns off the stepping motor and other driving devices (step S17). Consequently, the platen roller 6 and roller pair 2 are brought to a stop, so that the conveyance of the paper 53 is stopped.

After the step S17, the controller 80 drives the motor 29 to its pressure OFF position via the motor driver 31 (step S18). The head 5 is therefore released from the platen roller 6, setting up a pressure OFF state. At the same time, the sensor 26 generates the release signal and sends it to the controller 80. Because the head 5 is released from the paper 53 and platen roller 6, it is disconnected from ground (insulated) despite the presence of the paper 53, platen roller 6, lead 15, and ground portion 16*a*.

In this manner, during recording operation, the static electricity deposited on, e.g., the paper 53 is released from the periphery of the platen roller 6, where the potential difference is small, to ground FG via the core 6*a*, lead 15, and ground portion 16*a*. In addition, static electricity to remain on the periphery of the platen roller 6 and that of the head 5 can be noticeably reduced. After the recording operation has ended, the head 5 is released from the platen roller 6. In this condition, a current path formed by the platen roller 6, paper 53, and cracks 13 and traces 14 of impurities formed in the surface of the head 5 is interrupted. In addition, there can be obviated a small current tending to flow through the current path due to the potentials of the paper 53, platen roller 6, and so forth.

Particularly, when the head 5 is released from the platen roller 6, the pressure cancelling mechanism 20 maintains the head 5 spaced from the paper 53 containing corrosive substances. This reduces the corrosion of the head 5 more effectively, compared to the case wherein the head 5 and platen roller 6 are released with the paper 53 adhering to the head 5.

Further, because the pressure is cancelled with the head 5 being released from the paper 53 and platen roller 6, there can be obviated an occurrence that the paper 53 adheres to the platen roller 6 or the platen roller 6 deforms due to aging and/or varying environmental conditions.

This embodiment obviates the problem ascribable to corrosive substances contained in, e.g., an antistatic agent applied to the recording surface 53*a* of the paper 53 and discussed earlier in relation to the conventional structure. It is therefore possible to reduce the corrosion of the expensive head 5 in any environment while ensuring the desirable conveyance of the paper 53, thereby reducing defective images. The embodiment reduces the burden on the user and extends the life of the head 5. Extending the life of the head 5 is desirable from the environment standpoint.

As shown in FIG. 6, the various structural elements of the device 51 are positioned such that the portion of the paper 53 existing on an imaginary line connecting the paper pay-out position of the roll 53*b* and the nip of the roller pair 2 is constantly positioned below the bottom of the head 5, while a preselected degree of braking force or tension is constantly applied to the above portion of the paper 53, as in the first embodiment. It is therefore possible to maintain the head 5 spaced from the platen roller 6 and thereby prevent the paper 53 from slackening and contacting the surface of the head 5. This reduces the corrosion of the head 5 more positively.

Figure 13:
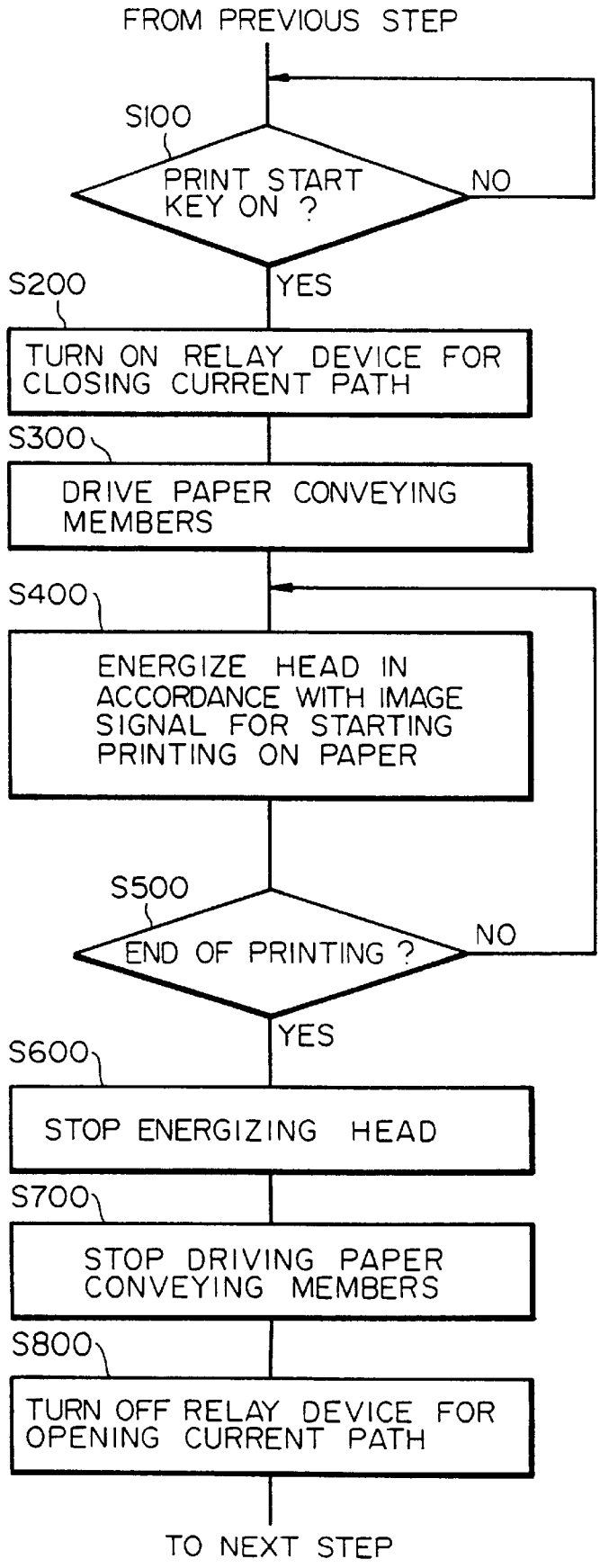

Referring to FIGS. 9, 10 and 13, a thermal recording device representative of a fourth embodiment of the present invention will be described. As shown in FIG. 9, the thermal recording device, a controller and a paper or similar thermosensitive recording medium are respectively designated by the parenthesized reference numerals 91, 95 and 53 in distinction from the master making device 41, controller 45 and stencil 3 of the second embodiment. The recording device 91, like the master making device 41 of the second embodiment, includes the thermal head 5, conductive platen roller 6, roller pair 2, relay device 42, and head support member 46. This embodiment includes a controller 95 for thermally printing an image on the paper 53 as distinguished from the stencil 3.

The structural elements of the recording device 91 identical with the structural elements of the master making device 41 are designated by identical reference numerals, and a detailed description thereof will not be made in order to avoid redundancy. This embodiment, like the third embodiment, additionally includes a mechanism for cutting the paper 53 and a device for driving the platen roller 6 and/or the roller pair 2, although not shown specifically.

The controller 95 receives a signal from a print start key provided on an operation panel and ON/OFF signals from various sensors and switches associated with drive portions to be controlled, and feeds the ON/OFF command to the relay control circuit 43. In addition, the controller 95 controls the system relating to the starts, stops and timings of the drive sections to be controlled.

The controller 95 has a microcomputer and includes a CPU, an I/O port, a ROM, a RAM, and so forth which are interconnected by a signal bus. The ROM stores a program and data for executing the operation of the device 91 which will be described later.

The controller 95 plays the role of control means for causing, during recording operation, the relay device 42 to close the current path connected to the platen roller 6 via the relay control circuit 43. While the recording operation is not under way, the controller or control means 95 causes the relay device 42 to open the above current path via the relay control circuit 43.

FIG. 13 is a flowchart demonstrating the general operation of the illustrative embodiment, i.e., controller 95. Again, details of the operation will be additionally described, as needed. As shown, the controller 95 determines whether or not the print start key is pressed (step S100). If the answer of the step S100 is YES, the controller 95 delivers the ON command to the relay control circuit 43 for thereby energizing (ON) the relay device 42 (step S200). As a result, the relay device 42 is turned on (see FIG. 10), closing the current path connected to the platen roller 6. Consequently, the head 5, paper 53 and platen roller 6 are connected to ground FG via the lead 15 and ground portion 16*a*. If the answer of the step S100 is NO, the procedure returns.

As soon as the relay device 42 is turned on via the relay control circuit 43, the controller 95 causes the stepping motor connected to the platen roller 6 and other driving devices to start rotating (step S300). As a result, the platen roller 6 and roller pair 2 are caused to rotate, conveying the paper 53 in the subscanning direction F. A printing operation starts in a step S400. Specifically, in the step S400, the heating elements 10 of the head 5 selectively generate heat in accordance with an image signal and thereby causes the recording surface 53*a* of the paper 53 contacting the elements 10 to color. Consequently, a dot image is formed on the part of the paper 53 intervening between the platen roller 6 and the head 5. In this case, because the relay device 42 is turned on to close the current path connected to the platen roller 6. the roller 6 is connected to ground FG via the lead 15 and ground portion 16*a*. Therefore, static electricity deposited on the platen roller 6 during the conveyance of the paper 53 is released to ground FG via the core 6*a*, lead 15, and ground portion 16*a*.

Subsequently, the controller 95 determines whether or not the recording operation has ended (step S500). Again, this decision may be made on the basis of whether or not a preselected period of time has elapsed since the disappearance of the image signal or whether or not all the documents stacked on a tray, not shown, have been fed. If the answer of the step S500 is NO, the procedure returns to the step S400.

If the answer of the step S500 is YES, the controller 95 causes the energization of the head 5 to be stopped (step S600). Subsequently, the controller 95 turns off the stepping motor and other driving devices (step S700). Consequently, the platen roller 6 and roller pair 2 are brought to a stop, so that the conveyance of the paper 53 is stopped.

After the step S700, the controller 95 delivers the OFF command to the relay control circuit 43 in order to turn off the relay device 42 (step S800). As a result, the relay device 42 is turned off (see FIG. 9). Consequently, the current path connected to the platen roller 6 is opened. More specifically, the current path extending from the head 5 to the lead 15 via the paper 53 and platen roller 6 and the current path extending from the ground portion 16*a* to ground FG are opened. Therefore, the head 5 is disconnected from ground (insulated) despite the presence of the paper 53, platen roller 6, lead 15.

In this manner, during recording operation, static electricity deposited on, e.g., the paper 53 during conveyance is released from the periphery of the platen roller 6, where the potential difference is small, to ground FG via the core 6*a*, lead 15, and ground portion 16*a*. In addition, static electricity to remain on the periphery of the platen roller 6 and that of the head 5 can be noticeably reduced. After the recording operation, the current path formed by the platen roller 6, stencil 3, cracks 13, traces 14 of impurities, lead electrodes 11 and heating elements 10 is interrupted. In addition, a small current is prevented from flowing through the above current path due to a potential deposited on, e.g., the paper 53 or the platen roller 6.

This embodiment also obviates the problem ascribable to the corrosive substances contained, e.g., an antistatic agent applied to the recording surface 53*a* of the paper 53 and discussed earlier in relation to the conventional structure. It is therefore possible to reduce the corrosion of the expensive head 5 in any environment while ensuring the desirable conveyance of the paper 53, thereby reducing defective images. The embodiment reduces the burden on the user and extends the life of the head 5. Extending the life of the head is desirable from the environment standpoint.

In this embodiment, the platen roller 6 is connected to ground FG via the relay device or opening/closing means 42. Alternatively, the heating elements 10 of the head 5 may be connected to ground FG via the relay device 42 which opens and closes the current path extending from the head 5 to ground FG, in which case the controller 95 will also execute the procedure described previously.

The heating elements 10 may be connected to ground FG either directly or by way of the lead electrodes 11 connected to the heating elements 10.

If desired, the pressure cancelling mechanism 20 and controller 80 included in the third embodiment may be added to the configuration described above. With this configuration, it is possible to achieve the advantages particular to the pressure cancelling mechanism 20 while achieving the advantages of the fourth embodiment more positively.

This embodiment may also included manual holding means for holding, when the device 91 is expected to be left unused over a long period of time, the head 5 of the head support member 46 in the position spaced from the platen roller 6. In such a case, the various structural elements of the device 91 will be positioned such that the portion of the paper 53 existing on the imaginary line connecting the paper pay-out position of the roll 53*b* and the nip of the roller pair 2 is constantly positioned below the bottom of the head 5, while a preselected degree of braking force or tension will be constantly applied to the above portion of the paper 53. With the manual holding means, it is possible to maintain the head 5 spaced from the platen roller 6 and thereby prevent the paper 53 from slackening and contacting the surface of the head 5. This reduces the corrosion of the head 5 more positively.

In summary, it will be seen that the present invention provides a thermal master making device and a thermal recording device having various unprecedented advantages, as enumerated below.

(1) In a thermal recording device, when a thermosensitive paper or similar thermosensitive recording medium is conveyed during, e.g., recording operation, moving means holds a thermal head in contact with a conductive platen roller via the paper. At this instant, static electricity deposited on, e.g., the paper during conveyance is released from the periphery of the platen roller, where the potential difference is small, to ground. Therefore, static electricity to remain on the periphery of the platen roller and that of the head can be noticeably reduced. When the recording operation is not under way, the moving means maintains the head spaced from the platen roller. In this condition, a current path ascribable to the platen roller, paper, cracks and traces of impurities formed in the surface of the head, A1 lead electrodes and heating elements is interrupted. In addition, there can be obviated a small current tending to flow through the current path due to the potentials of the paper, platen roller, and so forth.

(2) Therefore, there can be obviated the problem ascribable to corrosive substances contained in, e.g., an antistatic agent applied to the surface of the paper contacting the head and discussed earlier in relation to the conventional structure. It is therefore possible to reduce the corrosion of the expensive head in any environment while ensuring the desirable conveyance of the paper, thereby reducing defective images. This reduces the burden on the user and extends the life of the head. Extending the life of the head is desirable from the environment standpoint also.

(3) In the thermal recording device, when the paper is conveyed during, e.g., recording operation, opening/closing means closes a current path so as to connect either one of the platen roller and the heating elements of the head to ground. As a result, conduction is set up between the head, paper, and platen roller. At this instant, static electricity deposited on, e.g., the paper during conveyance is released from either one of the platen roller and heating elements where the potential difference is small. Therefore, static electricity to remain on the periphery of the platen roller and that of the head can be noticeably reduced. When the paper is not conveyed, e.g., when the recording operation is not under way, the opening/closing means opens the current path and thereby interrupts the current path ascribable to the platen roller, paper, cracks and traces of impurities formed in the surface of the head, A1 lead electrodes and heating elements. In addition, there can be obviated a small current tending to flow through the current path due to the potentials of the paper, platen roller, and so forth.

(4) This is also successful to achieve the advantages stated in the above item (2).

(5) In a thermal master making device, when a thermosensitive stencil is conveyed during, e.g., master making operation, moving means holds a thermal head in contact with a conductive platen roller via the stencil. At this instant, static electricity deposited on, e.g., the stencil during conveyance is released from the periphery of the platen roller, where the potential difference is small, to ground. Therefore, static electricity to remain on the periphery of the platen roller and that of the head can be noticeably reduced. When the master making operation is not under way, the moving means maintains the head spaced from the platen roller. In this condition, a current path ascribable to the platen roller, stencil, cracks and traces of impurities formed in the surface of the head, A1 lead electrodes and heating elements is interrupted. In addition, there can be obviated a small current tending to flow through the current path due to the potentials of the stencil, platen roller, and so forth.

(6) Therefore, there can be obviated the problem ascribable to corrosive substances contained in one or more of a plurality of layers formed on the thermoplastic resin film of the stencil and discussed earlier in relation to the conventional structure. It is therefore possible to reduce the corrosion of the expensive head in any environment while ensuring the desirable conveyance of the stencil, thereby reducing defective images. This reduces the burden on the user and extends the life of the head. Extending the life of the head is desirable from the environment standpoint also.

(7) In the thermal master making device, when the stencil is conveyed during, e.g., master making operation, opening/closing means closes a current path so as to connect either one of the platen roller and the heating elements of the head to ground. As a result, conduction is set up between the head, stencil, and platen roller. At this instant, static electricity deposited on, e.g., the stencil during conveyance is released from either one of the platen roller and heating elements where the potential difference is small. Therefore, static electricity to remain on the periphery of the platen roller and that of the head can be noticeably reduced. When the stencil is not conveyed, e.g., when the master making operation is not under way, the opening/closing means opens the current path and thereby interrupts the current path ascribable to the platen roller, stencil, cracks and traces of impurities formed in the surface of the head, A1 lead electrodes and heating elements. In addition, there can be obviated a small current tending to flow through the current path due to the potentials of the stencil, platen roller, and so forth.

(8) This is also successful to achieve the advantages stated in the above item (6).

(9) When the stencil is implemented substantially only by a thermoplastic resin film, it lacks elasticity and is difficult to convey. Even if the amount of antistatic agent contained in the stencil is increased in order to solve such a problem, the above advantages are achievable. In addition, images free from fiber marks are guaranteed.

(10) Because the platen roller has a volume resistivity of less than $10^7$ Ω·cm inclusive, the advantages (1)–(9) are achievable even in severe operating conditions.

(11) During image recording, control means controls the moving means such that the head and platen roller contact each other via the paper. While the image recording operation is not under way, the control means causes the moving means to release the head and platen roller from each other. This also successfully achieves the advantages (1) and (2).

(12) During image recording, control means causes the opening/closing means to close either one of the current path of the platen roller and that of the head. While the image recording operation is not under way, the control means causes the opening/closing means to open either one of the above current paths. This also successfully achieves the advantages (3) and (4).

(13) During master making operation, control means controls the moving means such that the head and platen roller contact each other via the stencil. While the master making operation is not under way, the control means causes the moving means to release the head and platen roller from each other. This also successfully achieves the advantages (5) and (6).

(14) During master making operation, control means causes the opening/closing means to close either one of the current path of the platen roller and that of the head. While the master making recording operation is not under way, the control means causes the opening/closing means to open either one of the above current paths. This also successfully achieves the advantages (7) and (8).

Various modifications will become possible for those skilled in the art after receiving the teachings of the present disclosure without departing from the scope thereof.

What is claimed is:

1. A device for thermally perforating a thermosensitive stencil moving in a subscanning direction in accordance with an image signal to thereby make a master, said device comprising:

a conductive platen roller having at least a circumferential surface thereof formed of a conductive material;

a thermal head including a plurality of heating elements arranged in a main scanning direction perpendicular to the subscanning direction, said plurality of heating elements being selectively energized in accordance with the image signal to thereby thermally perforate the thermosensitive stencil;

opening/closing means for selectively opening and closing a current path to thereby connect said plurality of heating elements to ground; and control means for causing said opening/closing means to close said current path of said plurality of heating elements during master making and to open said current path when the master making is not under way;

a pressure canceling mechanism for selectively moving said thermal head and said platen roller into and out of contact with each other, wherein said pressure canceling mechanism maintains said thermal head spaced from the thermosensitive stencil so as to prevent contact between said thermal head and said thermosensitive stencil.

2. A device as claimed in claim 1, wherein said pressure canceling mechanism includes a motor selectively driving a cam so as to move said thermal head.

3. A device as claimed in claim 2, wherein said thermal head is pivotally mounted on a shaft, said cam is located near an opposite end of said thermal head from said heating elements so that a movement of said cam against said thermal head in one direction causes said thermal head to move in an opposite direction away from said platen roller.

4. A device according to claim 3, wherein said pressure canceling mechanism further includes a spring for biasing said thermal head toward said platen roller.

5. A device as claimed in claim 2, wherein said motor also rotates a cam feeler in relation to a sensor so that the position of the cam is detected.

6. The device as claimed in claim 1, wherein a braking force from a braking means constantly acts on the stencil so as to prevent the stencil from coming into contact with said thermal head when it is out of contact with said platen roller and so that the stencil contacts the platen roller.

7. A device as claimed in claim 1, wherein a tension from a tension means constantly acts on said stencil so as to prevent the stencil from coming into contact with said thermal head when it is out of contact with said platen roller and so that the stencil contacts the platen roller.

* * * * *

UNITED STATES PATENT AND TRADEMARK OFFICE

CERTIFICATE OF CORRECTION

PATENT NO. : 6,050,184

DATED : APRIL 18, 2000

INVENTOR(S): Yasunobu KIDOURA, et al.

It is certified that an error appears in the above-identified patent and that said Letters Patent is hereby corrected as shown below:

Column 5, line 4, change "It" to --11--.

Column 6, line 35, change "assailable" to --available--.

Column 8, line 27, change "It" to --11--.

Column 14, line 4, change "4 5" to --45--;

line 23, change "510" to --S10--.

Column 15, line 53, delete "w it" insert --with--;

line 54, delete "h".

Column 19, line 44, change "." to --,--.

Signed and Sealed this

Tenth Day of April, 2001

*Attest:*

Nicholas P. Godici

NICHOLAS P. GODICI

*Attesting Officer*

*Acting Director of the United States Patent and Trademark Office*